US009788692B2

(12) United States Patent
Chenoweth

(10) Patent No.: US 9,788,692 B2
(45) Date of Patent: Oct. 17, 2017

(54) DUAL PANEL SHOWER CURTAIN

(71) Applicant: Thomas C. Chenoweth, Fort Myers, FL (US)

(72) Inventor: Thomas C. Chenoweth, Fort Myers, FL (US)

( * ) Notice: Subject to any disclaimer, the term of this patent is extended or adjusted under 35 U.S.C. 154(b) by 385 days.

(21) Appl. No.: 13/859,558

(22) Filed: Apr. 9, 2013

(65) Prior Publication Data

US 2014/0298581 A1 Oct. 9, 2014

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/558, 608
See application file for complete search history.

(56) References Cited

U.S. PATENT DOCUMENTS

| | | | | |
|---|---|---|---|---|
| 2,120,155 | A | 6/1938 | Shera | |
| 2,173,993 | A | 9/1939 | Amdur | |
| 2,188,163 | A * | 1/1940 | Sherman | 160/327 |
| 2,212,326 | A | 8/1940 | Piken | |
| 2,232,194 | A | 2/1941 | Zogby | |
| 2,303,502 | A | 12/1942 | Rous | |
| 2,608,250 | A | 8/1952 | Meyer | |
| 2,668,298 | A | 2/1954 | Kimmons | |
| 2,771,945 | A | 11/1956 | Wittrup | |
| 2,776,439 | A | 1/1957 | Rondinelli | |
| 2,817,850 | A | 12/1957 | Barbour et al. | |
| 2,840,155 | A | 6/1958 | Stern | |
| 3,107,361 | A | 10/1963 | Glutting | |
| 4,070,735 | A | 1/1978 | Canaday | |
| 4,077,072 | A | 3/1978 | Dezura | |
| 4,126,172 | A | 11/1978 | Faragher | |
| 4,279,396 | A | 7/1981 | Bendock | |
| 4,333,187 | A | 6/1982 | Schuler | |
| 4,385,409 | A | 5/1983 | File et al. | |
| 4,496,059 | A | 1/1985 | Leiter | |

(Continued)

FOREIGN PATENT DOCUMENTS

| | | |
|---|---|---|
| CA | 2178968 | 12/1997 |
| CA | 2501075 | 8/2006 |

(Continued)

*Primary Examiner* — Janie Loeppke

(57) ABSTRACT

A dual panel shower curtain (30) having an outer panel (32) and an inner panel (34) that may be partially attached to each other with attachments (52) that are preferably arranged in a vertical grid pattern on an upper portion (72) of the dual panel shower curtain (30). Lower portions (74) of the outer panel (32) and the inner panel (34) are not attached to each other, thereby allowing the lower portions (74) of the outer panel (32) and the inner panel (34) to straddle the front wall (20) of the bathtub shower enclosure (10). An additional feature of an embodiment is offset apertures (48) and/or offset attachments (52) to create vertical channels (56) between the outer panel (32) and the inner panel (34) through which air can travel more freely. A further feature of an embodiment is side edges (36, 38) that are not attached to each other, thereby allowing side edges (36) of the outer panel (32) to overlap the outside of the bathtub shower enclosure (10) and the side edges (38) of the inner panel (34) to overlap, lay flat, and seal against the end walls of the bathtub shower enclosure (10).

31 Claims, 15 Drawing Sheets

(56) References Cited

U.S. PATENT DOCUMENTS

| | | | | |
|---|---|---|---|---|
| 4,594,741 | A | 6/1986 | Payne | |
| D289,842 | S * | 5/1987 | Schomaker | D6/575 |
| 4,723,326 | A | 2/1988 | Tarlow et al. | |
| 4,754,504 | A | 7/1988 | Cellini | |
| 4,777,673 | A | 10/1988 | Patterson et al. | |
| 4,916,764 | A | 4/1990 | Meaden et al. | |
| 4,931,342 | A * | 6/1990 | Tolbert et al. | 428/90 |
| 4,955,422 | A | 9/1990 | Irizarry | |
| 5,007,120 | A | 4/1991 | Annand | |
| 5,022,104 | A | 6/1991 | Miller | |
| 5,023,964 | A | 6/1991 | Unsworth | |
| 5,031,257 | A | 7/1991 | Jeffery | |
| 5,033,132 | A | 7/1991 | Greenblatt | |
| 5,070,551 | A | 12/1991 | Harrison et al. | |
| 5,097,541 | A | 3/1992 | Annand | |
| 5,148,580 | A | 9/1992 | Dyckow | |
| 5,170,974 | A | 12/1992 | Ruggiero | |
| 5,186,232 | A * | 2/1993 | Zahner | 160/330 |
| D334,682 | S | 4/1993 | Weeks | |
| 5,228,149 | A | 7/1993 | Phinn, Jr. | |
| 5,243,715 | A | 9/1993 | Barmak | |
| 5,305,477 | A | 4/1994 | Cochran | |
| 5,337,425 | A | 8/1994 | Hill | |
| 5,345,992 | A | 9/1994 | Turner | |
| 5,421,393 | A | 6/1995 | Wolfe | |
| 5,448,786 | A | 9/1995 | Anderson | |
| D373,041 | S | 8/1996 | Michaelson | |
| 5,732,419 | A | 3/1998 | Feist | |
| 5,732,420 | A | 3/1998 | Micciche | |
| 5,771,504 | A | 6/1998 | Steiner | |
| 5,809,589 | A | 9/1998 | Johnson | |
| 5,826,284 | A | 10/1998 | Wren | |
| 5,953,771 | A | 9/1999 | VanHuss | |
| 5,974,603 | A | 11/1999 | Frazier | |
| 6,032,306 | A | 3/2000 | Gummin | |
| 6,038,749 | A | 3/2000 | Eberhardt | |
| 6,041,454 | A | 3/2000 | Summerford | |
| 6,094,755 | A | 8/2000 | Matta | |
| 6,154,894 | A | 12/2000 | Alexander et al. | |
| 6,163,899 | A | 12/2000 | Leonard | |
| 6,189,597 | B1 | 2/2001 | Cheng | |
| 6,195,816 | B1 | 3/2001 | Glassman | |
| 6,199,225 | B1 | 3/2001 | Colvin | |
| 6,263,523 | B1 | 7/2001 | Moore | |
| 6,276,002 | B1 | 8/2001 | Oschmann | |
| 6,292,957 | B1 | 9/2001 | Thompson | |
| 6,317,904 | B1 | 11/2001 | Samelson | |
| 6,412,124 | B1 | 7/2002 | Anderson | |
| 6,488,070 | B1 | 12/2002 | Cox | |
| 6,494,248 | B1 | 12/2002 | Zahner | |
| 6,546,571 | B2 | 4/2003 | Samelson | |
| 6,550,525 | B1 | 4/2003 | Grisolia | |
| 6,591,432 | B1 | 7/2003 | Feinstein et al. | |
| 6,655,444 | B2 | 12/2003 | Goldenberg et al. | |
| 6,715,163 | B1 | 4/2004 | Cunningham | |
| D489,966 | S | 5/2004 | Ho | |
| 6,834,704 | B2 * | 12/2004 | Cheng | 160/349.2 |
| 6,836,909 | B1 | 1/2005 | Kirsopp | |
| 6,857,140 | B1 | 2/2005 | Broudy | |
| 6,935,402 | B2 | 8/2005 | Zahner | |
| 6,996,862 | B1 | 2/2006 | Shippy et al. | |
| 7,273,084 | B2 | 9/2007 | Chen | |
| 7,296,609 | B2 | 11/2007 | Zahner | |
| 7,350,244 | B1 | 4/2008 | Handley | |
| 7,600,274 | B2 | 10/2009 | Washington | |
| 7,770,243 | B1 | 8/2010 | Wise | |
| D655,552 | S | 3/2012 | Beyda | |
| D655,553 | S | 3/2012 | Beyda | |
| 2003/0131405 | A1 | 7/2003 | Greaves | |
| 2004/0034921 | A1 | 2/2004 | Yarid | |
| 2005/0103452 | A1 | 5/2005 | Adams et al. | |
| 2006/0026747 | A1 | 2/2006 | Prabhakar | |
| 2006/0200901 | A1 | 9/2006 | Beyda | |
| 2007/0245482 | A1 * | 10/2007 | Jenkins | A47K 3/38 4/558 |
| 2007/0256232 | A1 * | 11/2007 | Erickson | 4/558 |
| 2008/0229491 | A1 * | 9/2008 | Gregory | 4/558 |
| 2008/0283202 | A1 | 11/2008 | Serio, III et al. | |
| 2009/0272502 | A1 | 11/2009 | Brown | |
| 2010/0243181 | A1 * | 9/2010 | O'Connor | 160/236 |
| 2011/0219533 | A1 | 9/2011 | Hu et al. | |
| 2012/0227179 | A1 * | 9/2012 | Beyda | 4/608 |

FOREIGN PATENT DOCUMENTS

| | | |
|---|---|---|
| DE | 2020978 | 11/1971 |
| DE | 3509115 | 9/1986 |
| DE | 29606634 | 4/1996 |
| DE | 202004013594 | 11/2004 |
| EP | 370840 | 5/1990 |
| EP | 1424031 | 6/2004 |
| EP | 2027804 | 2/2009 |
| FR | 2637173 | 4/1990 |
| GB | 2361455 | 10/2001 |
| GB | 2422539 | 2/2006 |
| WO | WO90/06713 | 6/1990 |

* cited by examiner

DUAL PANEL SHOWER CURTAIN

BACKGROUND OF THE INVENTION

This invention relates to shower curtains that keep shower spray inside of a bathtub shower enclosure and more particularly to a dual panel shower curtain that further prevents air pressure, caused by a running shower, from pushing and pulling a shower curtain and a shower curtain liner inward into the bathtub shower enclosure. A dual panel shower curtain consists of a full shower curtain and a semi-attached full shower curtain liner that straddle either side of the front wall of a bathtub shower enclosure. Alternatively, a dual panel shower curtain consists of a two-panel semi-attached full shower curtain liner wherein the outer panel and the inner panel straddle either side of the front wall of a bathtub shower enclosure. In reference to a two-panel semi-attached full shower curtain liner, an individual may install a decorative shower curtain to hide the outer panel from view.

Oftentimes a running shower causes an area of low pressure within a bathtub shower enclosure. This area of low pressure causes air pressure to push a shower curtain and pull a shower curtain liner inward into a bathtub shower enclosure toward an individual during a running shower. This can be unpleasant for the individual and unhygienic depending on the age and cleanliness of the shower curtain. Although there have been many attempts to minimize the effects of air pressure on a shower curtain and a shower curtain liner, these attempts fail to provide a shower curtain that provides enough strength or features to overcome the problem. Further, such shower curtains create a second problem of not completely sealing the end walls of a bathtub shower enclosure to keep shower spray inside of the bathtub shower enclosure.

Therefore, a need exists for a dual panel shower curtain that remains in place and is not affected by air pressure caused by a running shower and a dual panel shower curtain that completely seals off the end walls of a bathtub shower enclosure to keep shower spray inside of the bathtub shower enclosure.

RELEVANT PRIOR ART

U.S. Pat. No. 2,120,155 (Shera, Jun. 7, 1938) shower curtain having weights and shower curtain having full inner panel and partial outer panel constituting bottom skirt.

U.S. Pat. No. 2,303,502 (Rous, Dec. 1, 1942) shower curtain having full inner panel and partial outer panel constituting bottom skirt.

U.S. Pat. No. 2,668,298 (Kimmons, Feb. 9, 1954) shower curtain having ventilation flaps.

U.S. Pat. No. 2,776,439 (Rondinelli, Jan. 8, 1957) shower curtain having full outer panel and partial inner panel constituting bottom skirt.

U.S. Pat. No. 3,035,275 (Strebeigh, May 22, 1962) shower curtain having top portion see-through viewing area and lower portion privacy area.

U.S. Des. Pat. 289,842 (Schomaker, May 19, 1987) shower curtain having trapezoidal shape wherein horizontal bottom edge is wider than horizontal top edge and vertical side edges are linear, convex, or concave.

U.S. Pat. No. 5,826,284 (Wren, Oct. 27, 1998) shower curtain having full outer panel and partial inner panel constituting bottom skirt.

U.S. Pat. No. 5,974,603 (Frazier, Nov. 2, 1999) shower curtain having full outer panel and partial inner panel constituting releasable bottom skirt.

U.S. Patent 2006/0200901 (Beyda, Sep. 14, 2006) shower curtain having full outer panel and full inner panel with a laminated upper portion, an unlaminated lower portion outer skirt and inner skirt, and weights in unlaminated lower portion outer skirt and inner skirt.

U.S. Des. Pat. 655,552 (Beyda, Mar. 13, 2012) shower curtain liner having lower portion concave side edges.

U.S. Des. Pat. 655,553 (Beyda, Mar. 13, 2012) shower curtain liner having full outer panel and partial inner panel constituting bottom skirt.

This invention shower curtain comprises a full outer panel and a full inner panel wherein upper portions of the panels are semi-attached to each other in a vertical pattern and lower portions of the panels are unattached to each other. Further, invention shower curtain comprises ventilation channels between upper portions of the panels. And further, the panels have weights or magnets near bottom edges of the panels. And further, invention shower curtain comprises approximately rectangular-shaped full outer panel and full inner panel with downward-sloping top corners that form trapezoidal-shaped outer panel and inner panel when hung from shower curtain rings or hung from a shower curtain bar. Further, full outer panel and full inner panel have respective apertures and each panel thereby hangs separately from shower curtain rings, alternatively full outer panel and full inner panel have shared apertures and the panels hang jointly from shower curtain rings, or alternatively full outer panel or full inner panel have apertures and the respective panel with apertures hangs from shower curtain rings and top edge of panel without apertures is semi-attached to near top edge of panel with apertures. And further, the panels have weights or magnets near bottom edges of the panels.

ADVANTAGES OF INVENTION OVER PRIOR ART

The dual panel shower curtain of the present invention minimizes the effects of air pressure on a shower curtain and a shower curtain liner during a running shower. Air pressure comes in two forms: drafts outside of a bathtub shower enclosure and drafts inside of a bathtub shower enclosure. Drafts outside of a bathtub shower enclosure push a shower curtain and a shower curtain liner inward toward an individual during a running shower, minimizing the interior space in a bathtub shower enclosure. Further drafts inside of a bathtub shower enclosure pull the shower curtain liner inward toward an individual during a running shower.

The dual panel shower curtain minimizes the effects of air pressure during a running shower in a number of ways. The dual panel shower curtain is constructed of conventional heavyweight air impermeable and water impermeable shower curtain material, e.g., polyvinyl chloride ("PVC"), ethylene vinyl acetate ("EVA"), polyethylene vinyl acetate ("PEVA"), or similar shower curtain material. The air impermeable property and the heavyweight property minimize the effects of air pressure pushing against the shower curtain and the shower curtain liner.

Further, the dual panel shower curtain is constructed of two panels of air impermeable and heavyweight shower curtain material wherein the upper portions of the shower curtain panel and the shower curtain liner panel are attached to each other and the lower portions of the panels are not attached to each other. Thus, the lower portion of the shower curtain panel straddles the outside of the front wall of the bathtub and the lower portion of the shower curtain liner panel straddles the inside of the front wall of the bathtub. The heavyweight property, the semi-attachment property, and the straddling property minimize the effects of air pressure pulling the shower curtain liner panel inward toward an individual during a running shower.

And further, the dual panel shower curtain is constructed of two full panels of heavyweight shower curtain material, a combined weight that contributes to minimizing the effects of air pressure on the shower curtain and the shower curtain liner.

Further, the dual panel shower curtain keeps shower spray inside a bathtub shower enclosure during a running shower. Whereas the upper portions of the shower curtain panel and the shower curtain liner panel are semi-attached to each other, the side edges of the upper portions of the panels are not attached to each other. The full panel of shower curtain material, in combination with the unattached side edges, allows an individual to pull the shower curtain liner panel across the full length of the bathtub shower enclosure and position the side edges of the inner panel (shower curtain liner panel) to overlap, lay flat, and seal against vertical length of the end walls of the bathtub shower enclosure and the inside of the bathtub. The dual panel shower curtain of the present invention illustrates numerous constructions of the shower curtain panel and the shower curtain liner panel that provide additional shower curtain material to overlap, lay flat, and seal against the end walls of the bathtub shower enclosure and the inside of the bathtub. Some embodiments are panels having a rectangular shape, a trapezoidal shape, a convex shape, and pleated side edges.

And further, the dual panel shower curtain may be constructed with weights or magnets positioned along the bottom edges of the full panels that help minimize the effects of air pressure on the shower curtain panel and the shower curtain liner panel. The heavyweight shower curtain material in addition to the gravitation pull downward of the weights or magnets on the shower curtain panel and the shower curtain liner panel further helps minimize the effects of air pressure on the panels.

Further, individuals may enjoy the ease, convenience and money saving features of purchasing a combined shower curtain and shower curtain liner. A combined shower curtain and shower curtain liner is a single product that is easier and more convenient to install than two separate products and less expensive than purchasing a separate shower curtain and a separate shower curtain liner.

The relevant prior art includes the following references:

| Pat. No. | Inventor | Issue/Publication Date |
|---|---|---|
| (U.S. Patent References) | | |
| D655,553 | Beyda | Mar. 13, 2012 |
| D655,552 | Beyda | Mar. 13, 2012 |
| 2011/0219533 | Hu et al. | Sep. 15, 0211 |
| 7,770,243 | Wise | Aug. 10, 2010 |
| 2009/0272502 | Brown | Nov. 05, 2009 |
| 7,600,274 | Washington | Oct. 13, 2009 |
| 2008/0283202 | Serio, III et al. | Nov. 20, 2008 |
| 2008/0229491 | Gregory | Sep. 25, 2008 |
| 7,350,244 | Handley | Apr. 01, 2008 |
| 7,296,609 | Zahner | Nov. 20, 2007 |
| 2007/0256232 | Erickson | Nov. 08, 2007 |
| 2007/0245482 | Jenkins | Oct. 25, 2007 |
| 7,273,084 | Chen | Sep. 25, 2007 |
| 2006/0200901 | Beyda | Sep. 14, 2006 |
| 6,996,862 | Shippy et al. | Feb. 14, 2006 |
| 2006/0026747 | Prabhakar | Feb. 09, 2006 |
| 6,935,402 | Zahner | Aug. 30, 2005 |
| 2005/0103452 | Adams et al. | May 19, 2005 |
| 6,857,140 | Broudy | Feb. 22, 2005 |

-continued

| Pat. No. | Inventor | Issue/Publication Date |
|---|---|---|
| 6,836,909 | Kirsopp | Jan. 04, 2005 |
| D489,966 | Ho | May 18, 2004 |
| 6,715,163 | Cunningham | Apr. 06, 2004 |
| 2004/0034921 | Yarid | Feb. 26, 2004 |
| 6,655,444 | Goldenberg et al. | Dec. 02, 2003 |
| 2003/0131405 | Greaves | Jul. 17, 2003 |
| 6,591,432 | Feinstein et al. | Jul. 15, 2003 |
| 6,550,525 | Grisolia | Apr. 22, 2003 |
| 6,546,571 | Samelson | Apr. 15, 2003 |
| 6,494,248 | Zahner | Dec. 17, 2002 |
| 6,488,070 | Cox | Dec. 03, 2002 |
| 6,412,124 | Anderson | Jul. 02, 2002 |
| 6,317,904 | Samelson | Nov. 20, 2001 |
| 6,292,957 | Thompson | Sep. 25, 2001 |
| 6,276,002 | Oschmann | Aug. 21, 2001 |
| 6,263,523 | Moore | Jul. 24, 2001 |
| 6,199,225 | Colvin | Mar. 13, 2001 |
| 6,195,816 | Glassman | Mar. 06, 2001 |
| 6,189,597 | Cheng | Feb. 20, 2001 |
| 6,154,894 | Alexander et al. | Dec. 05, 2000 |
| 6,163,899 | Leonard | Dec. 26, 2000 |
| 6,094,755 | Matta | Aug. 01, 2000 |
| 6,041,454 | Summerford | Mar. 28, 2000 |
| 6,038,749 | Eberhardt | Mar. 21, 2000 |
| 6,032,306 | Gummin | Mar. 07, 2000 |
| 5,974,603 | Frazier | Nov. 02, 1999 |
| 5,953,771 | VanHuss | Sep. 21, 1999 |
| 5,826,284 | Wren | Dec. 27, 1998 |
| 5,809,589 | Johnson | Sep. 22, 1998 |
| 5,771,504 | Steiner | Jun. 30, 1998 |
| 5,732,420 | Micciche | Mar. 31, 1998 |
| 5,732,419 | Feist | Mar. 31, 1998 |
| D373,041 | Michaelson | Aug. 27, 1996 |
| 5,448,786 | Anderson | Sep. 12, 1995 |
| 5,421,393 | Wolfe | Jun. 06, 1995 |
| 5,345,992 | Turner | Sep. 13, 1994 |
| 5,337,425 | Hill | Aug. 16, 1994 |
| 5,305,477 | Cochran | Apr. 26, 1994 |
| 5,243,715 | Barmak | Sep. 14, 1993 |
| 5,228,149 | Phinn, Jr. | Jul. 20, 1993 |
| D334,682 | Weeks | Apr. 13, 1993 |
| 5,186,232 | Zahner | Feb. 16, 1993 |
| 5,170,974 | Ruggiero | Dec. 15, 1992 |
| 5,148,580 | Dyckow | Sep. 22, 1992 |
| 5,097,541 | Annand | Mar. 24, 1992 |
| 5,070,551 | Harrison et al. | Dec. 10, 1991 |
| 5,033,132 | Greenblatt | Jul. 23, 1991 |
| 5,031,257 | Jeffrey | Jul. 16, 1991 |
| 5,023,964 | Unsworth | Jun. 18, 1991 |
| 5,022,104 | Miller | Jun. 11, 1991 |
| 5,007,120 | Annand | Apr. 16, 1991 |
| 4,955,422 | Irizarry | Sep. 11, 1990 |
| 4,916,764 | Meaden at al. | Apr. 17, 1990 |
| 4,777,673 | Patteson et al. | Oct. 18, 1988 |
| 4,754,504 | Cellini | Jul. 05, 1988 |
| 4,723,326 | Tarlow et al. | Feb. 09, 1988 |
| D289,842 | Schomaker | May 19, 1987 |
| 4,594,741 | Payne | Jun. 17, 1986 |
| 4,496,059 | Leiter | Jan. 29, 1985 |
| 4,385,409 | File et al. | May 31, 1983 |
| 4,333,187 | Schuler | Jun. 08, 1982 |
| 4,279,396 | Bendock | Jul. 21, 1981 |
| 4,126,172 | Faragher, Jr. | Nov. 21, 1978 |
| 4,077,072 | Dezura | Mar. 07, 1978 |
| 4,070,735 | Canaday | Jan. 31, 1978 |
| 3,107,361 | Glutting | Oct. 22, 1963 |
| 2,840,155 | Stern | Jun. 24, 1958 |
| 2,817,850 | Barbour et al. | Dec. 13, 1957 |
| 2,776,439 | Rondinelli | Jan. 08, 1957 |
| 2,771,945 | Wittrup | Nov. 27, 1956 |
| 2,668,298 | Kimmons | Feb. 09, 1954 |
| 2,608,250 | Meyer | Aug. 26, 1952 |
| 2,303,502 | Rous | Dec. 01, 1942 |
| 2,232,194 | Zogby | Feb. 18, 1941 |
| 2,212,326 | Piken | Aug. 20, 1940 |
| 2,173,993 | Amdur | Sep. 26, 1939 |
| 2,120,155 | Shera | Jun. 07, 1938 |

-continued

| Pat. No. | Inventor | Issue/Publication Date |
|---|---|---|
| (Foreign Patent References) | | |
| EP2027804 | Gontar | Feb. 25, 2009 |
| CA2501075 | Dyckow | Aug. 14, 2006 |
| GB2422539 | King | Feb. 08, 2006 |
| DE202004013594 | Feng | Nov. 11, 2004 |
| EP1424031 | Grooms et al. | Jun. 02, 2004 |
| GB2361455 | Liu | Oct. 24, 2001 |
| CA2178968 | Moseson | Dec. 15, 1997 |
| DE29606634 | Hofmann | Apr. 14, 1996 |
| WO90/06713 | Jennings | Jun. 28, 1990 |
| EP370840 | Bachoux | May 30, 1990 |
| FR2637173 | Philippe | Apr. 06, 1990 |
| DE3509115 | Dirk et al. | Sep. 18, 1986 |
| DE2020978 | Schubert | Nov. 18, 1971 |

SUMMARY OF THE INVENTION

The primary object of the present invention is to provide a dual panel shower curtain whereby the shower curtain liner remains in place, unaffected by outside drafts and inside drafts created by air pressure in a bathtub shower enclosure during a running shower.

Another object of the present invention is to provide a dual panel shower curtain whereby the side edges of the shower curtain liner overlap, lay flat, and seal against the end walls of a bathtub shower enclosure and inside of the bathtub, thus keeping shower splash inside of the bathtub shower enclosure during a running shower.

A further object of the present invention is to provide a dual panel shower curtain having vertical channels whereby moisture caught between the shower curtain and the shower curtain liner dries quickly and minimizes the occurrence of mold and/or mildew in between the shower curtain and the shower curtain liner.

Another object of the present invention is to provide a dual panel shower curtain having weights or magnets spaced across the length of the bottom edges of the shower curtain and the shower curtain liner whereby the lower portions of the shower curtain and the shower curtain liner continue to straddle either side of the front wall of the bathtub shower enclosure when an individual draws closed or open the dual panel shower curtain along the full length of the bathtub shower enclosure, help keep the shower curtain liner stationary during a running shower to confine shower spray to inside of the bathtub shower enclosure, help keep the dual panel shower curtain drawn closed or open, and help keep neat vertical folds along the vertical length of the shower curtain and the shower curtain liner.

The present invention fulfills the above and other objects by providing a dual panel shower curtain comprising an inner panel, an outer panel, and attachment mean, such as heat welds, that join together in a semi-attached fashion the upper portions of the inner panel and the outer panel. The attachment means are preferably arranged in a vertical grid pattern or an elongated vertical grid pattern positioned between the upper portions of the inner panel and the outer panel. The lower portions of the inner panel and the outer panel are not attached to each other, wherein the lower portions of the inner panel and the outer panel straddle either side of the front wall of a bathtub shower enclosure.

The vertical pattern of attachment means, particularly where the attachment means positioned across between the upper portions of the inner panel and the outer panel are offset in relation to corresponding attachment means, creates vertical channels between the upper portions of the inner panel and the outer panel whereby air current travels more freely between the panels, maximizing the drying rate for moisture caught between the panels and minimizing the occurrence of mold and/or mildew between the panels. The vertical channels extend upward between the top edges of the inner panel and the outer panel, particularly where the apertures, grommets or attachment means positioned across between the top edge of each panel are offset in relation to corresponding apertures, grommets or attachment means, thereby creating openings across between the top edges between the panels.

A further feature of the present invention are the inner panel and the outer panel having side edges that are not attached to each other whereby the side edges of the inner panel may overlap, lay flat and seal against the end walls of a bathtub shower enclosure and inside of the bathtub to keep shower spray inside of the bathtub shower enclosure and inside of the bathtub and whereby the side edges of the outer panel may overlap the end walls outside of the bathtub shower enclosure to keep drafts outside the bathtub shower enclosure.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIGS. 41A-417D are FIGS. 37A-37D are rear views symmetrically positioned elongated attachment means joining together the upper portions of a rectangular-shaped outer panel and a rectangular-shaped inner, each panel having a reinforced header;

FIGS. 49-49D are FIGS. 48A-48D showing attachment means joining together the upper portions of a trapezoidal-shaped outer panel having a reinforced header and a trapezoidal-shaped inner panel having no reinforced header, and, attachment means joining together the top edge of the inner panel to proximate the top edge of the outer panel;

FIGS. 50A-50D are a reverse of FIGS. 49A-49D showing attachment means joining together the upper portions of a trapezoidal-shaped outer panel having no reinforced header and a trapezoidal-shaped inner panel having a reinforced header, and, attachment means joining together the top edge of the outer panel to proximate the top edge of the inner panel;

FIGS. 51A-51D are rear views of attachment means joining together the upper portions of a rectangular-shaped outer panel and a proximate rectangular-shaped inner panel having an angular convex top edge, each panel having a reinforced header;

FIGS. 52A-52E are FIGS. 51A-51D showing attachment means joining together either top corners of an outer panel and inner panel, causing the inner panel to have flared side edges;

FIGS. 53A-53E are FIGS. 52-52E showing attachment means joining together the upper portions of a rectangular-shaped outer panel having a reinforced header and a proximate rectangular-shaped inner panel having no reinforced header, and, attachment means joining together the top edge of the inner panel to proximate the top edge of the outer panel, causing the inner panel to have flared side edges;

FIGS. 54A-54E are a reverse of FIGS. 53A-53E showing attachment means joining together the upper portions of a proximate rectangular-shaped outer panel having no reinforced header and a rectangular-shaped inner panel having a reinforced header, and, attachment means joining together the top edge of the outer panel to proximate the top edge of the inner panel, causing the outer panel to have flared side edges;

DESCRIPTION OF THE PREFERRED EMBODIMENTS

Figure 1:
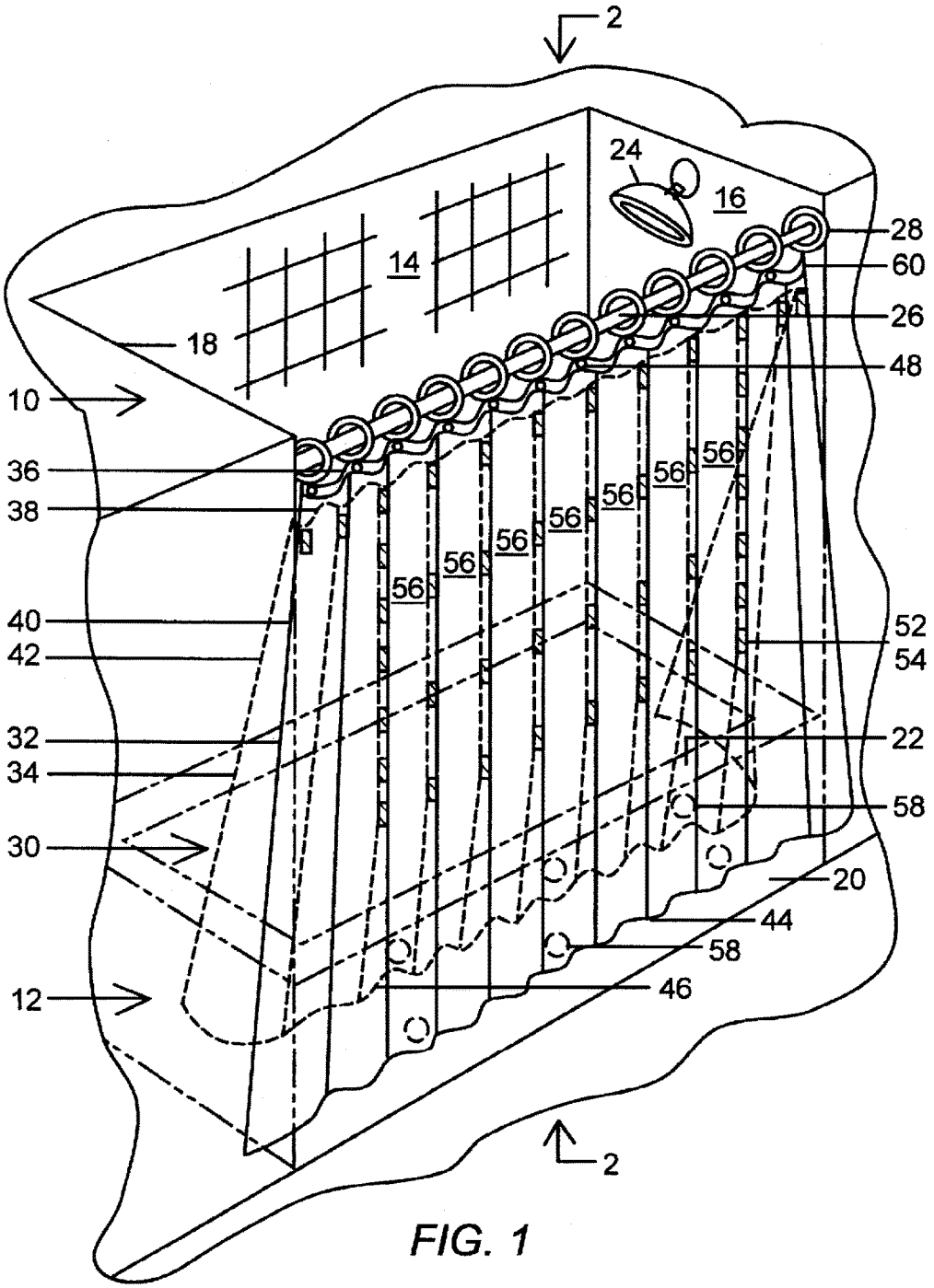
FIG. 1 is a front perspective plan view of a dual panel shower curtain of the present invention.
Figure 2:
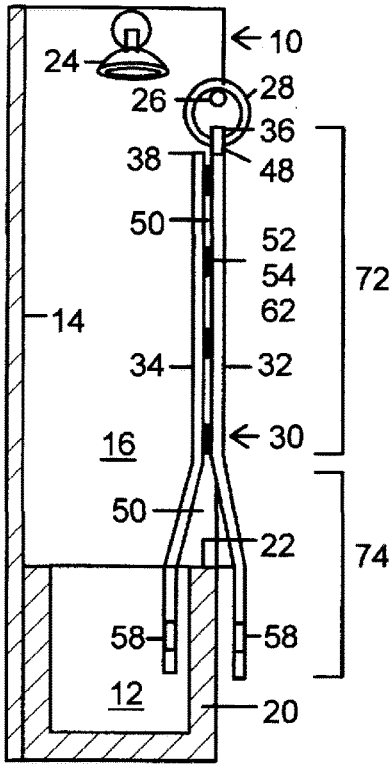
FIG. 2 is a cross section along line 2-2 of FIG. 1 through a vertical channel of a dual panel shower curtain of the present invention showing attachment means joining together upper portions of inner panel and an outer panel and the outer panel, having a reinforced header and apertures, hangs from a shower curtain rod via shower curtain rings.

For purposes of describing the preferred embodiment, the terminology used in reference to the numbered accessories in the drawings is as follows:

10 bathtub shower enclosure
12 bathtub
14 rear wall
16 end wall
18 end wall
20 front wall of bathtub
22 lip of front wall of bathtub
24 showerhead
26 shower curtain rod
28 shower curtain rings
30 dual panel shower curtain
32 outer panel
34 inner panel
36 top edge of outer panel
38 top edge of inner panel
40 side edge of outer panel
42 side edge of inner panel
44 bottom edge of outer panel
46 bottom edge of inner panel
48 aperture
50 opening
52 attachment means
54 heat weld
55 hook-and-loop fastener
56 vertical channel
58 weight
60 reinforced header
62 spacer
64 horizontal top middle edge of outer panel
66 horizontal top middle edge of inner panel
68 downward-sloping top corner edges of outer panel
70 downward-sloping top corner edges of inner panel
72 upper portion of dual panel shower curtain
74 lower portion of dual panel shower curtain
76 opaque
78 transparent
80 top corner of outer panel With reference to FIGS. 1 and 2, shown therein is a front perspective plan view of a dual panel shower curtain 30 of the present invention hanging in a bathtub shower enclosure 10 and a cross section along line 2-2 of FIG. 1 through a vertical channel 56 of a dual panel shower curtain 30, respectively.

The bathtub shower enclosure 10 comprises a bathtub 12, a rear wall 14, two end walls 16, 18, a front wall 20 of the bathtub 12, and a shower curtain, e.g., a dual panel shower curtain 30 of the present invention. A conventional showerhead 24 extends from end wall 16.

The dual panel shower curtain 30 hangs from a conventional shower curtain rod 26 via conventional shower curtain rings 28 or hooks that engage apertures 48 or grommets spaced across a top edge 36 of an outer panel 32 and a top edge 38 of an inner panel 34. The dual panel shower curtain 30 may also hang from a convention shower curtain rod 26 via split-ring apertures, U.S. Pat. No. 7,296,609 (Zahner, Nov. 20, 2007), without intervening conventional shower curtain rings 28 or hooks.

A dual panel shower curtain 30 comprises an outer panel 32 and an inner panel 34 and attachment means 52. The outer panel 32 and the inner panel 34 comprise top edges 36, 38, side edges 40, 42, bottom edges 44, 46, an upper portion 72, and a lower portion 74. The top edges 36, 38 are not attached to each other, the side edges 40, 42 are not attached to each other, the bottom edges 44, 46 are not attached to each other, and the lower portions 74 are not attached to each other. The upper portions 72 of the outer panel 32 and the inner panel 34 are semi-attached to each other by at least one attachment means 52, impermanent attachment means, permanent attachment means, or a combination of impermanent and permanent attachment means, e.g., adhesive, buttons, fastener strips, hook-and-loop fasteners 55, mounting strips, U.S. Pat. No. 6,317,904 (Samelson, Nov. 20, 2001), snaps, stitches, welds, e.g., friction welds, heat welds 54, high frequency welds, laser welds, radio frequency welds, ultrasonic welds, vibration welds, and so forth. The attachment means 52 of the dual panel shower curtain 30 are integral to the present invention.

The upper portions 72 of the outer panel 32 and the inner panel 34 of the dual panel shower curtain 30 are joined together by attachment means 52 in a semi-attached fashion via a plurality of attachment means 52. Further, the attachment means 52 are spaced latitudinally and longitudinally from each other, e.g., approximately 18 cm to 36 cm, in a vertical grid pattern thereby creating vertical channels 56 between the upper portions 72 of the outer panel 32 and the inner panel 34.

The side edges 40, 42 of the outer panel 32 and the inner panel 34 of the dual panel shower curtain 30 are not attached to each other allowing an individual to pull inward into the bathtub shower enclosure 10 the side edges 42 of the inner panel to overlap, lay flat, and seal against the vertical length of the end walls 16, 18 of the bathtub shower enclosure 10 and inside of the bathtub 12, thereby keeping shower spray inside of the bathtub shower enclosure 10.

The lower portions 74 of the dual panel shower curtain 30 are not attached to each other allowing the lower portions 74 of the outer panel 32 and the inner panel 34 to straddle either side of the front wall 20 of the bathtub 12.

The vertical grid pattern of the attachments means 52 is positioned between the outer panel 32 and the inner panel 34 of the dual panel shower curtain 30 approximately 20 to 40 cm above the lip 22 of the front wall 20 of the bathtub 12 and the vertical grid pattern of the attachment means 52 extends upward to approximately the top edges 36, 38 of the outer panel 32 and the inner panel 34. Further, the vertical grid pattern of the attachment means 52 is positioned between the outer panel 32 and the inner panel 34 approximately 30 to 60 cm from the side edges 40, 42 of the outer panel 32 and the inner panel 34.

The outer panel 32 and inner panel 34 of the dual panel shower curtain 30 are preferably constructed of conventional heavy-weight shower curtain material, e.g., 8-gauge or heavier, water impermeable and air impermeable material, such as polyvinyl chloride ("PVC"), ethylene vinyl acetate ("EVA"), polyethylene vinyl acetate ("PEVA"), and so forth.

The positioning of the apertures 48 across the top edge 36 of the outer panel 32 are preferably offset longitudinally in relation to the apertures 48 positioned across the top edge 38 of the inner panel 34, thereby creating openings 50 across between the top edges 36, 38 of the outer panel 32 and the inner panel 34. The spacing between each of the attachment means 52 across the outer panel 32 are preferably offset longitudinally in relation to the spacing between each of the attachment means 52 across the inner panel 34, thereby creating vertical channels 56 across between the upper portions 72 of the outer panel 32 and the inner panel 34. The offset apertures 48 and/or offset attachment means 52 are preferably vertically aligned to form contiguous vertical channels 56. The vertical channels 56 allow air flows outside and inside the bathtub shower enclosure 10 during a running shower to travel more freely between the outer panel 32 and the inner panel 34, thereby minimizing the effects of air pressure outside of the bathtub shower enclosure 10 and between the upper portions 72 and the lower portions 74 of the dual panel shower curtain 30. Further, the vertical channels 56 increase the rate at which moisture caught between the outer panel 32 and the inner panel 34 dries. And further, the increased air flow and increased drying rate minimize the occurrence of mold and/or mildew forming between the outer panel 32 and the inner panel 34.

Weights 58 or magnets may be positioned across the bottom edges 44, 46 of the outer panel 32 and the inner panel 34 of the dual panel shower curtain 30. The weights 58 or magnets are an additional feature to minimize the effects of air pressure outside of the bathtub shower enclosure 10 and between the upper portions 72 and the lower portions 74 of the dual panel shower curtain 30. Further, the weights 58 or magnets minimize the occurrence of flapping of the lower portion 74 of the inner panel 34 inward toward an individual during a running shower. And further, the weights 58 or magnets aid the lower portions 74 of the outer panel 32 and the inner panel 34 to straddle either side of the front wall 20 of the bathtub 12 either during a running shower or when an individual draws closed or open the dual panel shower curtain 30 along the length of the bathtub shower enclosure 10 in order to enter or exit the bathtub shower enclosure 10. Further, the weights 58 or magnets help keep the dual panel shower curtain 30 in an open or closed position when an individual draws open or closed the dual panel shower curtain 30. And further, the weights 58 or magnets help keep neat vertical folds in the dual panel shower curtain 30. The weights 58 or magnets may be made of any material.

The combination of the above features—attachment means 52, vertical grid pattern of the attachment means 52, spacing between each of the attachment means 52, vertical channels 56, unattached top edges 36, 38, unattached side edges 40, 42, unattached bottom edges 44, 46, semi-attached upper portions 72, unattached lower portions 74, heavy-weight water impermeable and air impermeable shower curtain material, offset apertures 48, offset attachment means 52, weights 58 or magnets—allows the dual panel shower curtain 30 to have the following properties:

- draft proof, maximizing space in a bathtub shower enclosure 10 during a running shower by minimizing the effects of air pressure on and between the outer panel 32 and the inner panel 34 and minimizing billowing inward of the upper portions 72 and the lower portions 74 of the outer panel 32 and the inner panel 34 toward an individual during a running shower;
- splash proof, keeping shower spray inside of the bathtub shower enclosure 10 during a running shower by sealing the side edges 40, 42 of the inner panel 34 against the end walls 16, 18 of the bathtub shower enclosure 10;
- mold and/or mildew proof, quickly drying moisture and minimizing the occurrence of mold/mildew between the outer panel 32 and the inner panel 34;
- straddle proof, keeping the lower portions 74 of the dual panel shower curtain 30 straddled on either side of the front wall 20 of the bathtub shower enclosure 10, keeping the bathroom floor dry when an individual draws open the wet inner panel 34 of a dual panel shower curtain 30 after a running shower, and keeping neat folds in the outer panel 32 and in the inner panel 34 when an individual draws open or closed the dual panel shower curtain 30;
- child proof, meeting or exceeding the safety guidelines of the U.S. Consumer Product Safety Commission for plastic sheet products by spacing attachment means 52 within approximately 18 cm of each other and/or spacing attachment means 52 within approximately 18 cm of each other for attachment means 52 positioned on the circumference of the vertical grid pattern of attachment means 52.

FIG. 1 shows a dual panel shower curtain 30 comprising offset attachments means 52 joining together the upper portions 72 of the outer panel 32 and the inner panel 34, the outer panel 32 hanging from a conventional shower curtain rod 26 via conventional shower curtain rings 28 or hooks that engage the apertures 48 or grommets spaced across the top edge 36 of the outer panel 32, and offset attachment means 52 joining together the top edge 38 of the inner panel 34 to approximately immediately below the apertures 48 or grommets across the top edge 36 of the outer panel 32. The offset attachment means 52 create vertical channels 56 for draft-proof, mold and/or mildew proof, and straddle proof features in a dual panel shower curtain 30.

With reference to FIG. 2, shown therein is a dual panel shower curtain 30 comprising attachment means 52 joining together the upper portions 72 of the outer panel 32 and the inner panel 34; the outer panel 32 hanging from a conventional shower curtain rod 26 via conventional shower curtain rings 28 or hooks that engage the apertures 48 or grommets spaced across the top edge 36 of the outer panel 32, and attachment means 52 joining together the top edge 38 of the inner panel 34 to approximately immediately below the apertures 48 or grommets across the top edge 36 of the outer panel 32.

Figure 3:
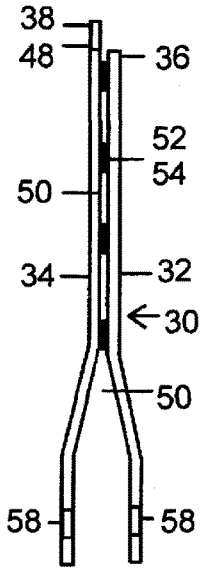
FIG. 3 is FIG. 2 showing an inner panel, having a reinforced header and apertures, hangs from a shower curtain rod via shower curtain rings.

FIG. 3 is the reverse of FIG. 2 showing a dual panel shower curtain 30 comprising attachment means 52 joining together the upper portions 72 of the outer panel 32 and the inner panel 34; the inner panel 34 hanging from a conventional shower curtain rod 26 via conventional shower curtain rings 28 or hooks that engage the apertures 48 or grommets spaced across the top edge 38 of the inner panel 34, and attachment means 52 joining together the top edge 36 of the outer panel 32 to approximately immediately below the apertures 48 or grommets across the top edge 38 of the inner panel 34.

Figure 4:
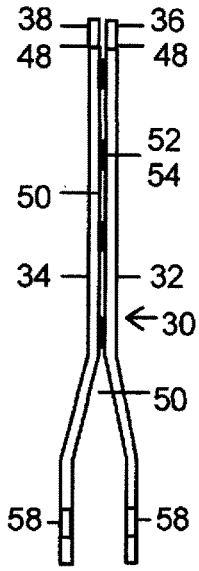
FIG. 4 is FIG. 3 showing an inner panel and an outer panel, each panel having a reinforced header and apertures, hang from a shower curtain rod via shower curtain rings.

FIG. 4 is similar to FIG. 2 showing the outer panel 32 and the inner panel 34 hanging from a conventional shower curtain rod 26 via conventional shower curtain rings 28 or hooks that engage the apertures 48 or grommets spaced across the top edge 36 of the outer panel 32 and across the top edge 38 of the inner panel 34.

Figure 5:
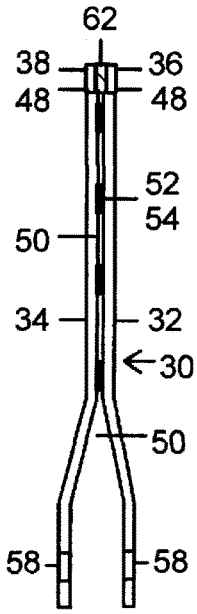
FIG. 5 is FIG. 4 showing a spacer between corresponding apertures.

FIG. 5 is similar to FIG. 4 showing the outer panel 32 and the inner panel 34 hanging from a conventional shower curtain rod 26 via conventional shower curtain rings 28 or hooks that engage the apertures 48 or grommets spaced across the top edge 36 of the outer panel 32 and across the top edge 38 of the inner panel 34. Spacers 62 are positioned between the apertures 48 or grommets of the outer panel 32 and the inner panel 34. Spacers 62 may be installed separately from the apertures 48 or grommets or the apertures 48 or grommets may join together simultaneously the spacers 62 and the top edges 36, 38 of the outer panel 32 and the inner panel 34.

Figure 6:
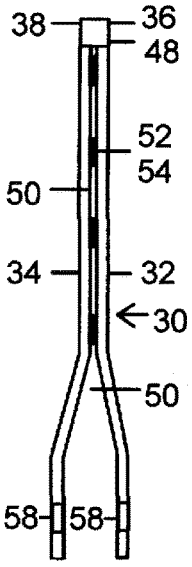
FIG. 6 is FIG. 4 showing apertures joining together the top edges of the inner panel and the outer panel.

FIG. 6 is similar, to FIG. 5 showing the outer panel 32 and the inner panel 34 hanging from a conventional shower curtain rod 26 via conventional shower curtain rings 28 or hooks. The apertures 48 or grommets join together the top edges 36, 38 of the outer panel 32 and the inner panel 34.

Figure 7:
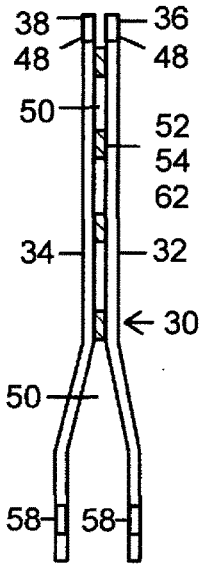
FIG. 7 is FIG. 4 showing spacers between corresponding attachment means.

FIG. 7 is similar to FIG. 4 showing the outer panel 32 and the inner panel 34 hanging from a conventional shower curtain rod 26 via conventional shower curtain rings 28 or hooks that engage the apertures 48 or grommets spaced across the top edge 36 of the outer panel 32 and across the top edge 38 of the inner panel 34. Spacers 62 are positioned between the attachment means 52 in between the outer panel 32 and the inner panel 34.

Figure 8:
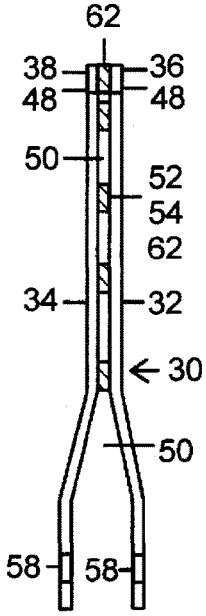
FIG. 8 is FIG. 7 showing spacers between corresponding apertures and between corresponding attachment means.

FIG. 8 is similar to FIG. 7 showing the outer panel 32 and the inner panel 34 hanging from a conventional shower curtain rod 26 via conventional shower curtain rings 28 or hooks that engage the apertures 48 or grommets spaced across the top edge 36 of the outer panel 32 and across the top edge 38 of the inner panel 34. Spacers 62 are positioned between the apertures 48 or grommets and spacers 62 are positioned between the attachment means 52 in between the outer panel 32 and the inner panel 34. Spacers 62 may be installed separately from the apertures 48 or grommets or the apertures 48 or grommets may join together simultaneously the spacers 62 and the top edges 36, 38 of the outer panel 32 and the inner panel 34.

Figure 9:
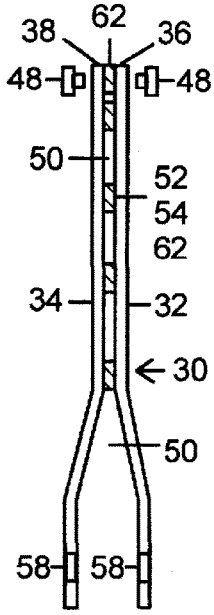
FIG. 9 is FIG. 8 showing spacers between corresponding apertures and apertures joining together the top edges of the inner panel and the outer panel.

FIG. 9 is similar to FIG. 8 showing the outer panel 32 and the inner panel 34 hanging from a conventional shower curtain rod 26 via conventional shower curtain rings 28 or hooks that engage the apertures 48 or grommets spaced across the top edge 36 of the outer panel 32 and across the top edge 38 of the inner panel 34. Spacers 62 are positioned between the apertures 48 or grommets and spacers 62 are positioned between the attachment means 52 in between the outer panel 32 and the inner panel 34. The apertures 48 or grommets join together the spacers 62 and the top edges 36, 38 of the outer panel 32 and the inner panel 34.

Figure 10:
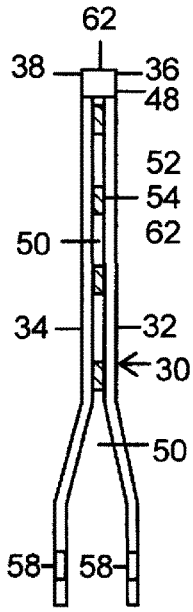
FIG. 10 is FIG. 9 showing corresponding apertures joining together the top edges of the inner panel and the outer panel.

FIG. 10 is similar to FIG. 9 showing the outer panel 32 and the inner panel 34 hanging from a conventional shower curtain rod 26 via conventional shower curtain rings 28 or hooks that engage the apertures 48 or grommets. The apertures 48 or grommets join together the top edges 36, 38 of the outer panel 32 and the inner panel 34. Spacers 62 are positioned between the attachment means 52 in between the outer panel 32 and the inner panel 34.

Figure 11:
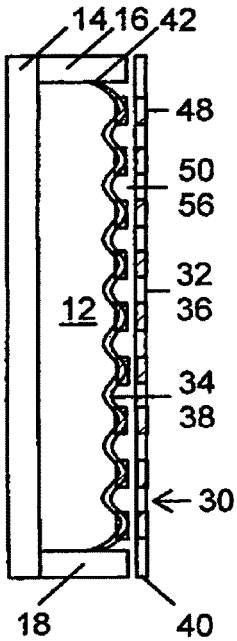
FIG. 11 is a top view of a dual panel shower curtain of the present invention showing a contracted inner panel and a flat outer panel, each panel having a reinforced header and apertures to hang separately each panel from a shower curtain rod via shower curtain rings or hooks.

With reference to FIG. 11 shown therein is a top view of a dual panel shower curtain 30 of the present invention showing offset apertures 48 and offset attachment means 52, e.g., heat welds 54, across the outer panel 32 and the inner panel 34. The apertures 48 or grommets positioned across the top edge 36 of the outer panel 32 are preferably offset in relation to the apertures 48 or grommets positioned across the top edge 38 of the inner panel 34, thereby creating openings 50 across between the top edges 36, 38. The attachment means 52 positioned across the vertical grid pattern between the upper portions 72 of the outer panel 32 and the inner panel 34 are preferably offset in relation to the attachment means 52 positioned across the vertical grid pattern of the inner panel 34. The offset apertures 48 and/or offset attachment means 52 create vertical channels 56 between the outer panel 32 and the inner panel 34 through which air can travel more freely. Side edges 40 of the outer panel 32 and side edges 42 of the inner panel 34 are preferably not attached to each other thereby allowing the side edges 42 of the inner panel 34 to be pulled inward into the bathtub shower enclosure 10 and overlap, lay flat, and seal against the vertical length of the end walls 16, 18 of the bathtub shower enclosure 10 and the inside of the bathtub 12, keeping shower spray inside of the bathtub shower enclosure 10. The top edge 36 of the outer panel 32 and the top edge 38 of the inner panel 34 are not joined together thereby hanging separately on a shower curtain rod 26 via shower curtain rings 28 or hooks. The inner panel 34 is a corrugated panel and the outer panel 32 is not a corrugated panel. A corrugated panel is panel comprising a plurality of vertical folds of shower curtain material. A panel that is not a corrugated panel is a panel that does not comprise a plurality of vertical folds of shower curtain material. A dual panel shower curtain 30 comprising attachment means 52 joining together a corrugated panel and a panel that is not a corrugated panel creates vertical channels 56 in between the outer panel 32 and the inner panel 34. A dual panel shower curtain 30 having a corrugated panel and a panel that is not a corrugated panel may be manufactured e.g., by positioning one panel on a frame or vacuum table having a corrugated form placing vertical folds in the panel, next stretching taut a second panel on top of both the first panel and on top of the frame or vacuum table, and then affixing the two panels together using attachment means 52, e.g., heat welds 54. The panels may be modified before or afterwards for reinforced headers 60, convex top edges 36, 38, weights 58 or magnets, and so forth.

Figure 12:
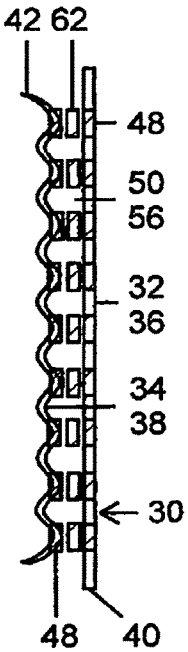
FIG. 12 is FIG. 11 showing spacers between the corresponding apertures of a contracted inner panel and a flat outer panel.
Figure 18:
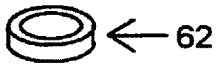
FIG. 18 is a front view of a spacer.

FIG. 12 is similar to FIG. 11 showing spacers 62 in FIG. 18 between the apertures 48 or grommets to allow for more air flow between the upper portions 72 of the outer panel 32 and the inner panel 74. The inner panel 34 is corrugated and the outer panel 32 is not corrugated, thereby creating vertical channels 56 between the outer panel 32 and the inner panel 34.

Figure 13:
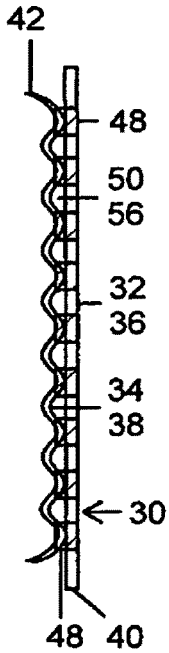
FIG. 13 is FIG. 11 showing apertures joining together the top edges of a contracted inner panel and a flat outer panel.

FIG. 13 is similar to FIG. 11 showing apertures 48 or grommets joining together the top edges 36, 38 of the outer panel 32 and the inner panel 34. The inner panel is corrugated and the outer panel is not corrugated, thereby creating vertical channels 56 between the outer panel 32 and the inner panel 34.

Figure 14:
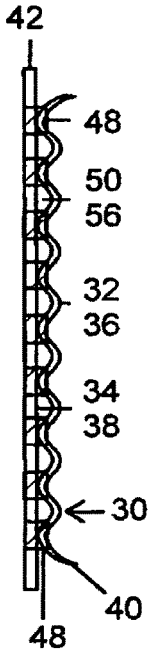
FIG. 14 is a reverse of FIG. 13 showing apertures joining together the top edges of a flat inner panel and a contracted outer panel.

FIG. 14 is the reverse of FIG. 13 showing apertures 48 or grommets joining together the top edges 36, 38 of the outer panel 32 and the inner panel 34. The outer panel 32 is corrugated and the inner panel is not corrugated, thereby creating vertical channels 56 between the outer panel 32 and the inner panel 34.

Figure 15:
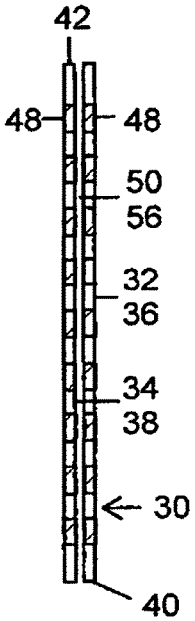
FIG. 15 is FIG. 11 showing a flat inner panel and a flat outer panel, each panel having a reinforced header and apertures to hang separately each panel from a shower curtain rod via shower curtain rings or hooks.

FIG. 15 is similar to FIG. 11 showing neither the outer panel 32 nor the inner panel 34 comprising a corrugated panel.

Figure 16:
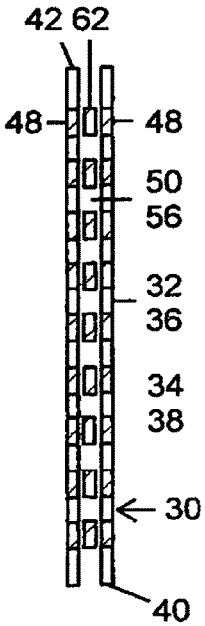
FIG. 16 is FIG. 15 showing spacers between the corresponding apertures of a flat inner panel and a flat outer panel.

FIG. 16 is similar to FIG. 15 showing spacers 62 in FIG. 18 positioned between the top edges 36, 38 of the outer panel 32 and the inner panel 34, thereby creating vertical channels 56 between the outer panel 32 and the inner panel 34.

Figure 17:
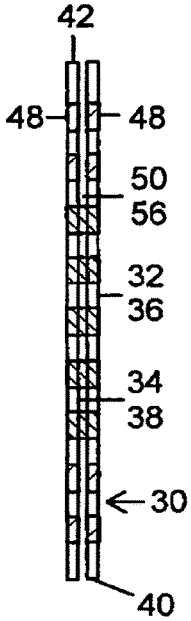
FIG. 17 is FIG. 16 showing at least one aperture joining together the top edges of a flat inner panel and a flat outer panel and at least one spacer positioned between corresponding apertures.

FIG. 17 is similar to FIG. 16 showing at least one aperture 48 or grommet joining together the top edge 36 of the outer panel 32 and the top edge 38 of the inner panel 34. At least one spacer 62 is positioned between the top edges 36, 38 of the outer panel 32 and the inner panel 34, thereby creating vertical channels 56 between the outer panel 32 and the inner panel 34.

With reference to FIG. 18, shown therein is a front perspective view of a spacer 62. Spacers 62 are constructed of conventional shower curtain material, e.g., water impermeable and air impermeable material, such as polyvinyl chloride ("PVC"), ethylene vinyl acetate ("EVA"), polyethylene vinyl acetate ("PEVA"), and so forth, or constructed of plastic such as mounting strips, U.S. Pat. No. 6,317,904 (Samelson, Nov. 20, 2001). Further examples of spacers 62 are illustrated in FIGS. 33A through 36B.

Figure 19:
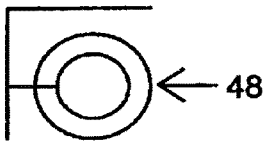
FIG. 19 is a front view of a split-ring aperture, U.S. Pat. No. 7,296,609 (Zahner, Nov. 20, 2007)

With reference to FIG. 19, shown therein is a front view of a split-ring aperture 48, U.S. Pat. No. 7,296,609 (Zahner, Nov. 20, 2007), whereby a shower curtain, e.g, a dual panel shower curtain 30 of the present invention, may be hung from a conventional shower curtain rod 26 without intervening conventional shower curtain rings 28 or hooks.

Figure 20A:
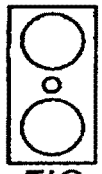
FIG. 20A is a front view and FIG. 20B is a side view of a suction cup fastener and plastic mounting strip, U.S. Pat. No. 6,317,904 (Samelson, Nov. 20, 2001)
Figure 20B:
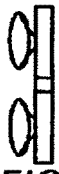

With reference to FIGS. 20A and 20B, shown therein are a front view and a side view, respectively, of suction cup mounting strips, U.S. Pat. No. 6,317,904 (Samelson, Nov. 20, 2001), wherein either side edges 42 of an inner panel 34 of a dual panel shower curtain 30 of the present invention may comprise at least one suction cup mounting strip sealing either side edges 42 of the inner panel 34 against the vertical length of the end walls 16, 18 of the bathtub shower enclosure 10 to keep shower spray inside of the bathtub shower enclosure 10 during a running shower.

Figure 21A:
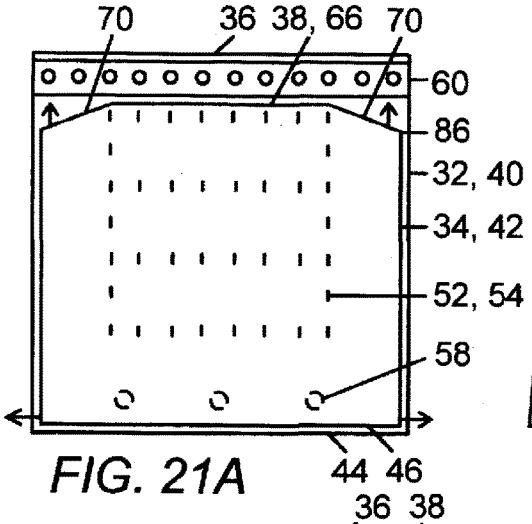
FIGS. 21A and 21B are before and after drawings showing a rear view of attachment means joining together the upper portions of a flat rectangular-shaped outer panel and a flat proximate rectangular-shaped inner panel having a convex upper edge, prior to installing attachment means to join together the upper corners of the inner panel to proximate upper corners of the outer panel; and, showing attachment means joining together the upper portions of a flat rectangular-shaped outer panel and a flat proximate rectangular-shaped inner panel having flared side edges, after installing attachments means joining together the upper corners of the inner panel to proximate upper corners of the outer panel.

With reference to FIG. 21A shown therein is a rear view of a dual panel shower curtain 30 having a rectangular-shaped outer panel 32 and a proximate rectangular-shaped inner panel 34 having a convex top edge 38 comprising a horizontal top middle edge 66 and downward-sloping top corner edges 70. Attachment means 52 join together in a vertical grid pattern the upper portions 72 of the outer panel 32 and the inner panel 34. The top edge 36 of the outer panel 32 hangs from a conventional shower curtain rod 26 via shower curtain rings 28 or hooks and attachment means 52 join together the top edge 38 of the inner panel 34 to proximate the top edge 36 of the outer panel 32.

Figure 21B:
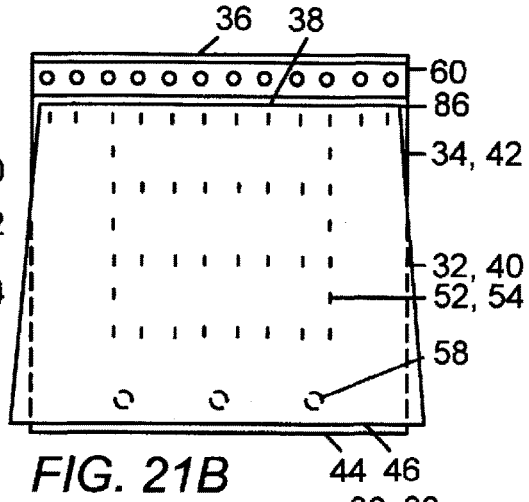

FIG. 21B shows FIG. 21A having downward-sloping top corner edges 70 of the inner panel 34 pulled upward and attachment means 52 joining together the downward-sloping top corner edges 70 of the inner panel 34 to proximate the top edge 36 of the outer panel 32. Further, FIG. 21B shows the flared effect on the side edges 42 of the inner panel 34 allowing the side edges 42 to overlap, lay flat, and seal against the vertical length of the end walls 16, 18 of the bathtub shower enclosure 10 and the inside of the bathtub 12 keeping shower spray inside of the bathtub shower enclosure 10 during a running shower.

Figure 22A:
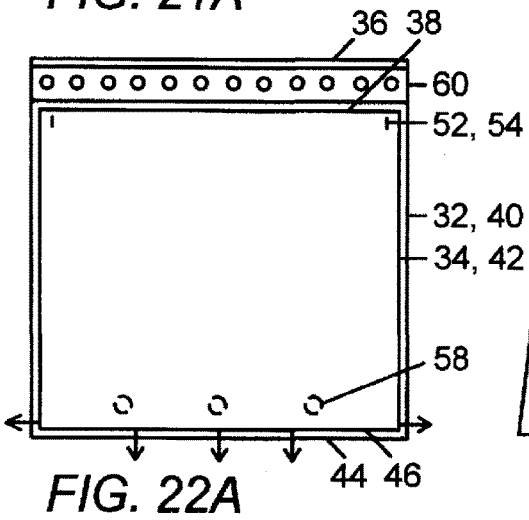
FIGS. 22A and 22B are before and after drawings showing a rear view of attachment means joining together the proximate upper corners of a flat rectangular-shaped outer panel and the upper corners of a flat rectangular-shaped inner panel shaped outer panel; and, showing attachment means joining together the upper corners and the upper portions of a flat rectangular shaped outer panel and a flat rectangular-shaped inner panel having flared side edges.

With reference to FIG. 22A shown therein is a rear view of a dual panel shower curtain 30 having a rectangular-shaped outer panel 32 and a rectangular-shaped inner panel 34 wherein attachment means 52 join together the top corner edges 70 of the inner panel 34 to proximate the top edge 36 of the outer panel 32.

Figure 22B:
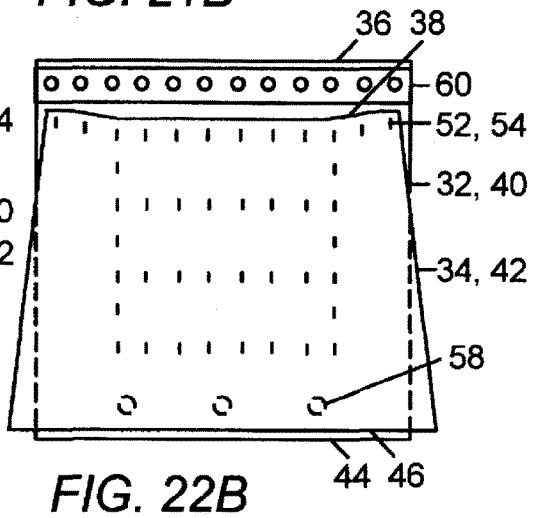

FIG. 22B shows FIG. 22A having the bottom edge 46 of the inner panel 34 pulled downward and attachment means 52 joining together the upper portions 72 of the outer panel 32 and the inner panel 34. Further, FIG. 22B shows the flared effect on the side edges 42 of the inner panel 34 allowing the side edges 42 to overlap, lay flat, and seal against the vertical length of the end walls 16, 18 of the bathtub shower enclosure 10 and the inside of the bathtub 12 keeping shower spray inside of the bathtub shower enclosure 10 during a running shower.

Figure 23A:
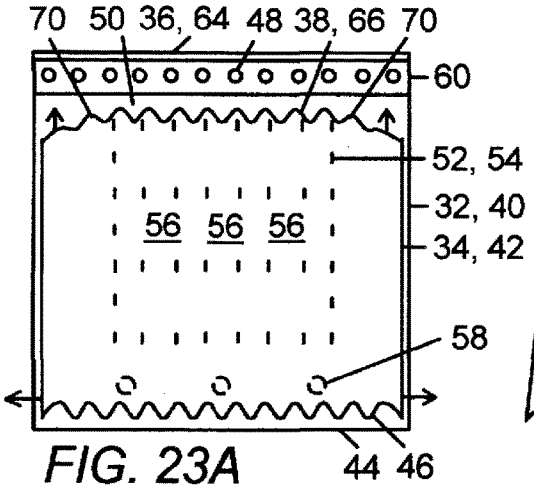
FIGS. 23A and 23B are FIGS. 21A and 21B before and after drawings showing a rear view of attachment means joining together the upper portions of a flat rectangular-shaped outer panel and a contracted proximate rectangular-shaped inner panel having a convex top edge, prior to installing attachment means to join together the upper corners of the inner panel to proximate upper corners of the outer panel; and, showing attachment means joining together the upper portions of a rectangular-shaped outer panel and a contracted proximate rectangular-shaped inner panel having flared side edges, after installing attachments means joining together the upper corners of the inner panel to proximate upper corners of the outer panel.

FIG. 23A shows a rear view of a dual panel shower curtain 30 having a rectangular-shaped outer panel 32 and a proximate rectangular-shaped corrugated inner panel 34 having a convex top edge 38 comprising a horizontal top middle edge 66 and downward-sloping top corner edges 70. Attachment means 52 join together in a vertical grid pattern the upper portions 72 of the corrugated inner panel 34 and the outer panel 32 and the outer panel 32 hangs from a shower curtain rod 26 via shower curtain rings 28 or hooks. Attachment means 52 join together the top edge 38 of the inner panel 34 to proximate the top edge 36 of the outer panel 32. The corrugated inner panel 34 creates vertical channels 56 between the upper portions 72 of the outer panel 32 and the inner panel 34 to allow for more air flow between the panels during and after a running shower thereby minimizing air pressure on the upper portions 72 and the lower portions 74 of the panels and minimizing the occurrence of mold and/or mildew between the panels.

Figure 23B:
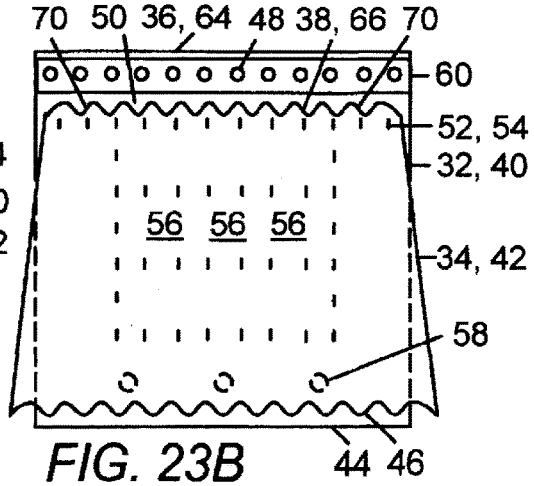

FIG. 23B shows FIG. 23A having either of the top corner edges 70 of the inner panel 34 pulled upward and attachment means 52 joining together the top corner edges 70 of the inner panel 34 to proximate the top edge 36 of the outer panel 32. Further, FIG. 23B shows the flared effect on the side edges 42 of the inner panel 34 allowing the side edges 42 to overlap, lay flat, and seal against the vertical length of the end walls 16, 18 of the bathtub shower enclosure 10 and the inside of the bathtub 12 keeping shower spray inside of the bathtub shower enclosure 10 during a running shower.

Figure 24A:
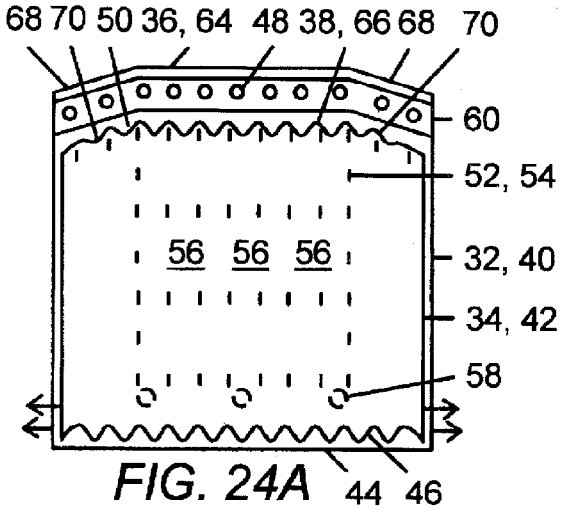
FIGS. 24A and 24B are FIGS. 23A and 23B before and after drawings showing a rear view of a pre-hung dual panel shower curtain wherein attachment means join together the upper portions of a flat outer panel and a contracted inner panel, each panel having a proximate rectangular shape and a convex top edge; and showing a rear view of a hung dual panel shower curtain wherein attachment means join together the upper portions of a flat outer panel and a contracted inner panel having flared side edges, each panel having a proximate rectangular shape and a horizontal top edge.
Figure 24B:
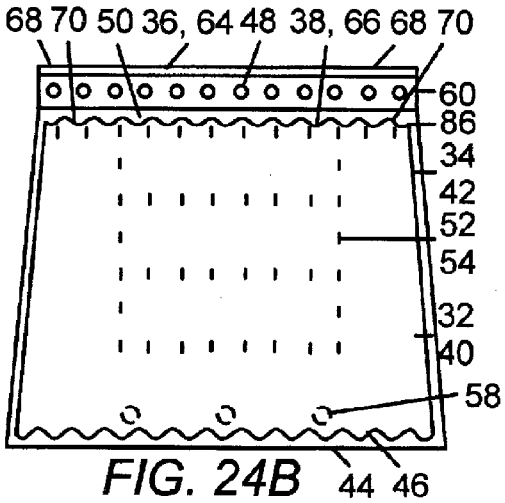

With reference to FIGS. 24A and 24B shown therein are before and after drawings of rear views of a dual panel shower curtain 30 in a pre-hung position in FIG. 24A and in a hung position FIG. 24B. FIG. 24A shows a proximate rectangular-shaped outer panel 32 having a convex top edge 36 comprising a horizontal top middle edge 64 and either downward-sloping top corner edges 68 and a proximate rectangular-shaped corrugated inner panel 34 having a convex top edge 38 comprising a horizontal top middle edge 66 and either downward-sloping top corner edges 70. The corrugated inner panel 34 creates vertical channels 56 for ventilation of the dual panel shower curtain 30 during and after a running shower minimizing the occurrence of mold and/or mildew between the outer panel 32 and the inner panel 34.

FIG. 24B shows FIG. 24A in a hung position. The convex top edges 36, 38 of the outer panel 32 and the inner panel 34 in FIG. 24A affect flared side edges 40, 42 of the outer panel 32 and the inner panel 34. The dimensions of the downward-sloping top corners edges 68, 70 are approximately 3 to 5 cm in height and approximately 30 to 40 cm in length for a conventional shower curtain. A convention shower curtain measures approximately 180 cm in height by 180 cm in width. When a dual panel shower curtain 30 is hung from a shower curtain bar 26 via shower curtain rings 28 or hooks, the convex top edge 36 of the outer panel 32 affects flared side edges 40 of the outer panel 32 keeping drafts outside of the bathtub shower enclosure 10. Likewise, the convex top edge 38 of the inner panel 34 affects flared side edges 42 of the inner panel 34 to overlap, lay flat, and seal against the vertical length of the end walls 16, 18 inside of the bathtub shower enclosure 10 and inside of the bathtub 12 during a running shower keeping shower spray inside of the bathtub shower enclosure 10.

Figure 25:
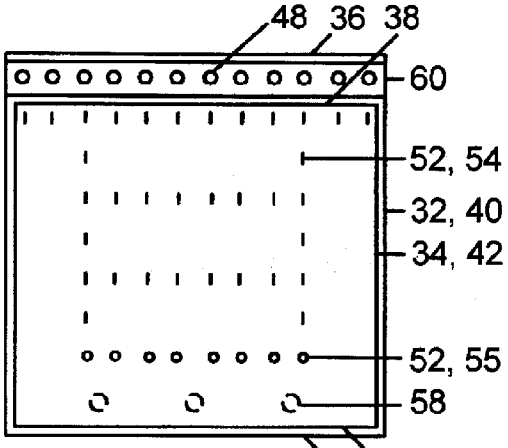
FIG. 25 is a rear view of dual panel shower curtain wherein permanent attachment means and impermanent attachment means join together the upper portions of a flat rectangular-shaped outer panel and a flat rectangular-shaped inner panel; impermanent attachment means are positioned across the bottom edge of the main body of attachment means.

With reference to FIG. 25 shown therein is a rear view of a dual panel shower curtain 30 comprising attachment means 52 joining together in a vertical grid pattern the upper portions 72 of a rectangular-shaped outer panel 32 and a rectangular-shaped inner panel 34. The attachment means 52 comprise permanent attachment means 52, e.g., heat welds 54, and impermanent attachment means 52, e.g., hook-and-loop fasteners 55, snaps, and so forth to allow an individual to attach or detach one or more bottom rows of attachment means 52 for different heights of the front wall 20 of the bathtub 12. The outer panel 32 hangs from a shower curtain rod 26 via shower curtain rings 28 or hooks and attachment means 52 join together the top edge 38 of the inner panel 34 proximate to the top edge 36 of the outer panel 32.

Figure 26:
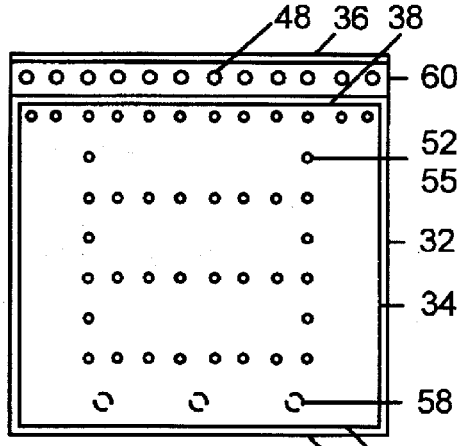
FIG. 26 is FIG. 25 showing impermanent attachment means joining together the upper portions of a flat rectangular-shaped outer panel and a flat rectangular-shaped inner panel.

FIG. 26 is similar to FIG. 25 showing attachment means 52 comprising impermanent attachment means 52, e.g., hook-and-loop fasteners, snaps, and so forth, joining together the upper portions 72 of the outer panel 32 and the inner panel 34 to allow an individual to attach or detach rows of attachment means 52 for different heights of the front wall 20 of the bathtub 12 or to detach panels to wash either panel or replace either panel with a new panel.

Figure 27:
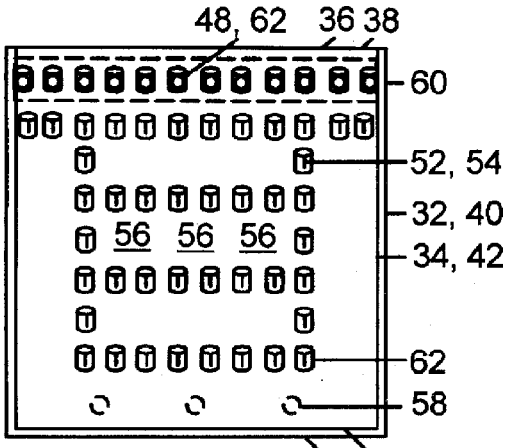
FIG. 27 is a rear view of attachment means joining together the upper portions of a rectangular-shaped outer panel and a rectangular-shaped inner panel wherein spacers are positioned between corresponding apertures and positioned between corresponding attachment means.

FIG. 27 is similar to FIG. 25 showing spacers 62 positioned between apertures 48 or grommets and spacers 62 positioned between attachment means 52 creating vertical channels 56 between the upper portions 72 of the outer panel 32 and the inner panel 34. The vertical channels 56 minimize the effects of air pressure on the upper portions 72 and the lower portions 74 of the outer panel 32 and the inner panel 34 and minimize the occurrence of mold and/or mildew between the outer panel 32 and the inner panel 34. The spacers 62 may be constructed of conventional shower curtain material, e.g., water impermeable and air impermeable material, such as polyvinyl chloride ("PVC"), ethylene vinyl acetate ("EVA"), polyethylene vinyl acetate ("PEVA"), and so forth, constructed of plastic such as mounting strips in FIGS. 20A and 20B, U.S. Pat. No. 6,317,904 (Samelson, Nov. 20, 2001), and so forth. The spacers 62 may be constructed in various forms, e.g., rings in FIG. 18, Z-tabs in FIG. 33A, U-tabs in FIG. 33B, rectangular tubes in FIG. 34A, circular tubes in FIG. 34B, rectangles in FIG. 35A, circles in FIG. 35B, rectangular bubbles in FIG. 36A, circular bubbles in FIG. 36B, and so forth.

Figure 28:
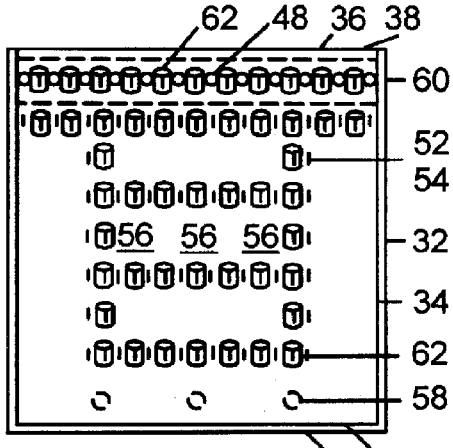
FIG. 28 is FIG. 27 showing attachment means joining together the upper portions of a rectangular-shaped outer panel and a rectangular shaped inner panel wherein spacers are positioned proximate to corresponding apertures and positioned proximate to corresponding attachment means.

FIG. 28 is similar to FIG. 27 wherein the spacers 62 are positioned between the upper portions 72 of the outer panel 32 and inner panel 34 in spaces between the attachment means 52 and in spaces between the apertures 48 or grommets creating vertical channels 56 between the upper portions 72 of the outer panel 32 and the inner panel 34. The vertical channels 56 allow air flow between the upper portions 72 of the outer panel 32 and inner panel 34 minimizing the effects of air pressure against and between the outer panel 32 and the inner panel 34 and minimizing the occurrence of mold and/or mildew between the panels.

Figure 29:
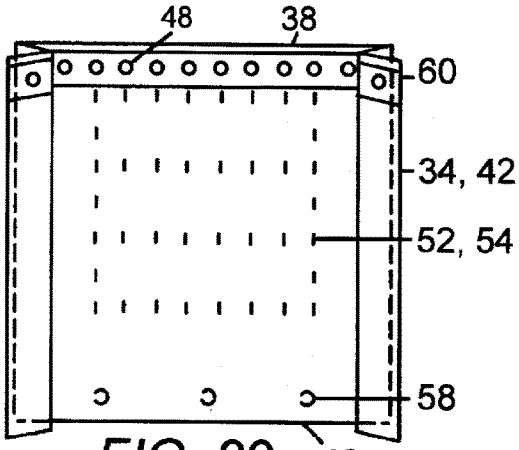
FIG. 29 is a front view of a wide flat rectangular-shaped inner panel having pleated side edges facing toward a rear wall of a bathtub shower enclosure.
Figure 30A:
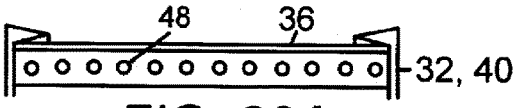
FIG. 30A is a partial rear view of a wide rectangular-shaped outer panel having pleated side edges facing toward a bathroom away from a bathtub shower enclosure.
Figure 30B:
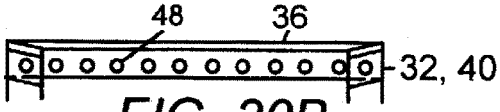
FIG. 30B is a partial rear view of a wide rectangular-shaped outer panel having pleated side edges facing toward a rear wall of a bathtub shower enclosure.
Figure 30C:
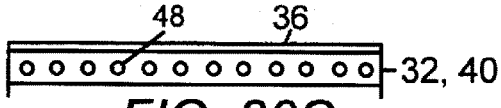
FIG. 30C is a partial rear view of a rectangular-shaped outer panel having no pleated side edges.
Figure 31:
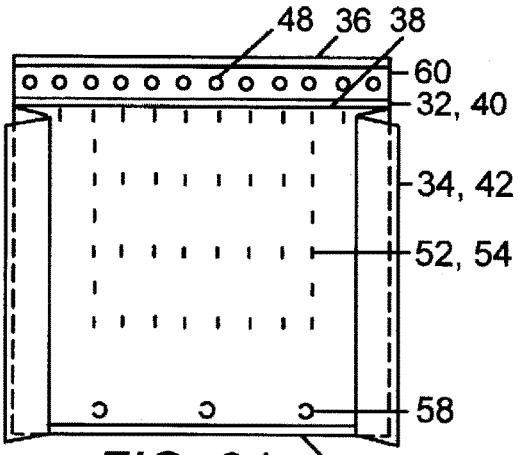
FIG. 31 is a combination of FIGS. 29 and 30C showing a rear view of a dual panel shower curtain having attachment means joining together a flat rectangular-shaped outer panel having no pleated side edges and a wide flat rectangular-shaped inner panel having pleated side edges.

With reference to FIGS. 29 through 31, shown therein are an outer panel 32 and an inner panel 34 comprising pleated side edges 40, 42 allowing the side edges 40, 42 to overlap, lay flat, and seal against the end walls 16, 18 of the bathtub shower enclosure 10. The pleated side edges 42 of the inner panel 34 keep shower splash inside of the bathtub shower enclosure 10 and inside of the bathtub 12. A convention shower curtain measures approximately 180 cm in height by 180 cm in width. An outer panel 32 or an inner panel 34 comprising pleated side edges 40, 42, respectively, measures approximately 15 cm wider on either side than a conventional shower curtain to create pleated side edges 40, 42 with the extra shower curtain material.

FIG. 29 shows a front view of an inner panel 34 comprising pleated side edges 42 facing inward toward the rear wall 14 of a bathtub shower enclosure 10. FIG. 30A shows a partial rear view of an outer panel 32 comprising pleated side edges 40 facing outward toward an open bathroom. FIG. 30B shows a partial view of an outer panel 32 comprising pleated side edges 40 facing inward toward the front wall 20 of a bathtub 12. FIG. 30C shows a partial view of a conventional rectangular-shaped outer panel 32.

FIG. 31 shows a rear view of a rectangular-shaped inner panel 34 and a rectangular-shaped outer panel 32 wherein attachment means 52 join together the upper portions 72 of the inner panel 34 and the outer panel 32 and attachment means 52 join together the top edge 38 of the inner panel 34 to proximate the top edge 36 of the outer panel 32. The inner panel 34 comprises pleated side edges 42 to overlap, lay flat, and seal against the vertical length of the end walls 16, 18 of the bathtub shower enclosure 10 and the inside of the bathtub 12, keeping shower splash inside of the bathtub shower enclosure 10. Not shown, either the outer panel 32 or the inner panel 34 may comprise a corrugated panel creating vertical channels 56 for air flow to minimize the effects of air pressure against and between the outer panel 32 and the inner panel 34 and to minimize the occurrence of mold and/or mildew between the outer panel 32 and the inner panel 34.

Figure 32:
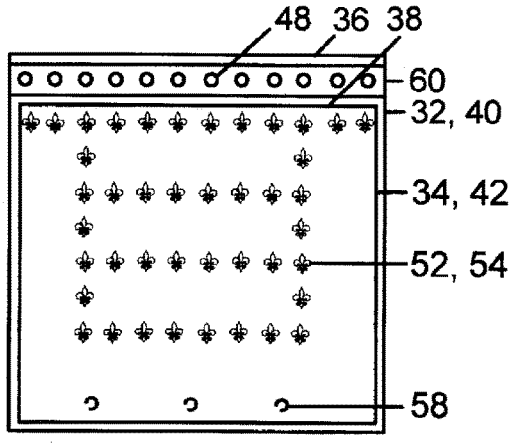
FIG. 32 is a rear view of dual panel shower curtain having decorative attachment means joining together the upper portions of a rectangular-shaped outer panel and a rectangular-shaped inner panel.

With reference to FIG. 32 shown therein is a rear view of dual panel shower curtain 30 comprising decorative attachment means 52, e.g., a fleur de lis attachment means, joining together the upper portions 72 of the outer panel 32 and the inner panel 34. Decorative attachment means 52 have a larger surface area adding strength and durability to the attachment means 52 and the dual panel shower curtain 30.

Figure 33A:
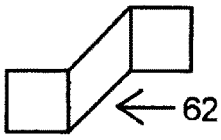
FIGS. 33A and 33B are side views of a Z-tab spacer and a C-tab spacer, respectively.
Figure 33B:
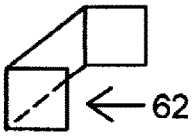
Figure 34A:
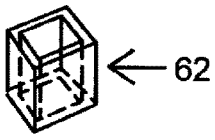
FIGS. 34A and 34B are perspective views of a rectangular tube spacer and a cylindrical tube spacer, respectively.
Figure 34B:
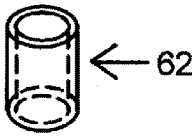
Figure 35A:
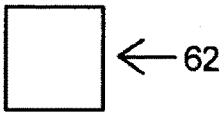
FIGS. 35A and 35B are front views of a flat rectangular spacer and a flat circular spacer, respectively.
Figure 35B:
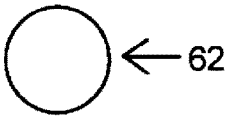
Figure 36A:
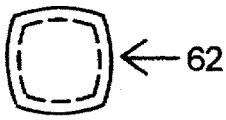
FIGS. 36A and 36B are front views of a rectangular bubble spacer and a circular bubble spacer.
Figure 36B:
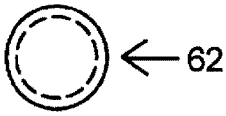
Figure 37A:
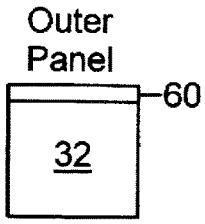
FIGS. 37A-37D are rear views symmetrically positioned attachment means joining together the upper portions of a rectangular-shaped outer panel and a rectangular-shaped inner, each panel having a reinforced header.
Figure 37B:
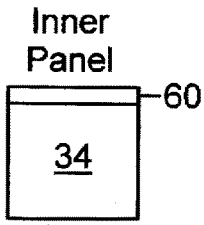
Figure 37C:
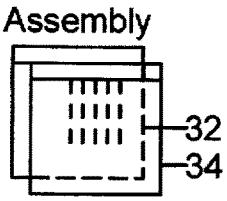
Figure 37D:
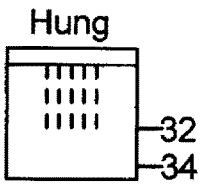
Figure 38A:
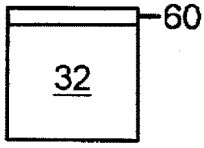
FIGS. 38A-38D are FIGS. 37A-37D showing attachment means joining together either top corners of an outer panel and inner panel.
Figure 38B:
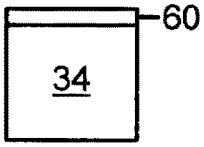
Figure 38C:
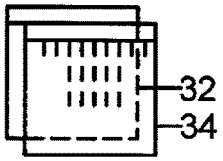
Figure 38D:
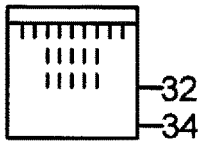
Figure 39A:
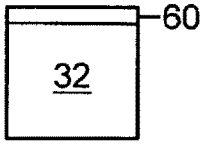
FIGS. 39A-39D are FIGS. 38A-38D showing attachment means joining together the upper portions of a rectangular-shaped outer panel having a reinforced header and a rectangular-shaped inner panel having no reinforced header, and, attachment means joining together the top edge of the inner panel to proximate the top edge of the outer panel.
Figure 39B:
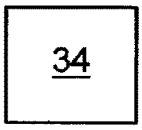
Figure 39C:
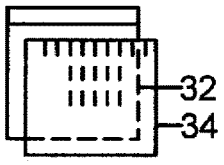
Figure 39D:
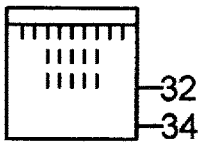
Figure 40A:
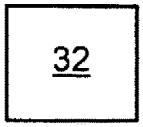
FIGS. 40A-40D are a reverse of FIGS. 39A-39D showing attachment means joining together the upper portions of a rectangular-shaped outer panel having no reinforced header and a rectangular-shaped inner panel having a reinforced header, and, attachment means joining together the top edge of the outer panel to proximate the top edge of the inner panel.
Figure 40B:
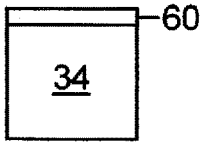
Figure 40C:
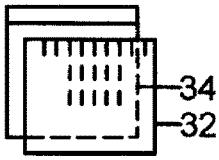
Figure 40D:
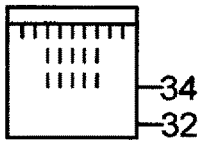
Figure 41A:
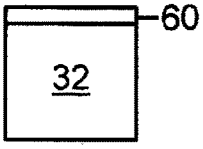
Figure 41B:
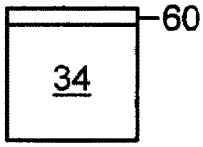
Figure 41C:
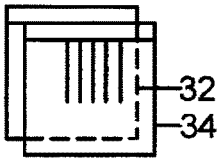
Figure 41D:
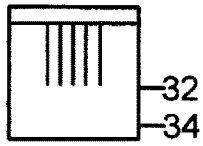
Figure 42A:
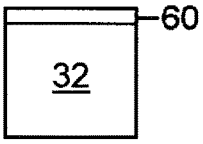
FIGS. 42A-42D are FIGS. 41A-41D showing attachment means joining together either top corners of an outer panel and inner panel.
Figure 42B:
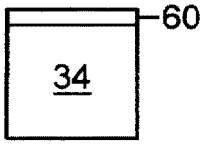
Figure 42C:
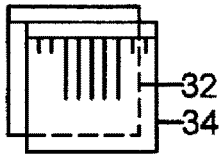
Figure 42D:
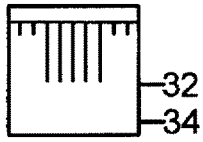
Figure 43A:
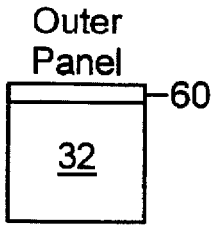
FIGS. 43A-43D are FIGS. 41A-41D showing elongated attachment means joining together the upper portions of an outer panel and an inner panel and attachment means extend upward to proximate the top edges of either panel.
Figure 43B:
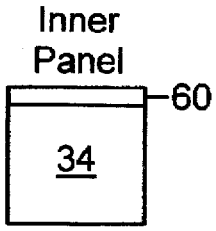
Figure 43C:
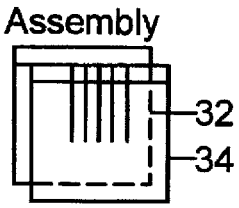
Figure 43D:
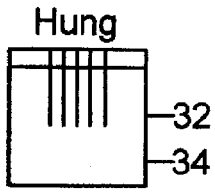
Figure 44A:
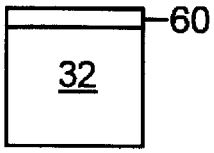
FIGS. 44A-44D are FIGS. 43A-43D showing attachment means joining together either top corners of an outer panel and inner panel.
Figure 44B:
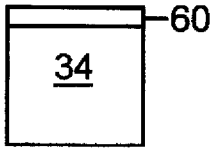
Figure 44C:
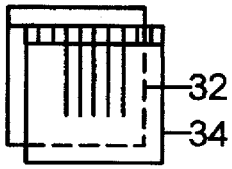
Figure 44D:
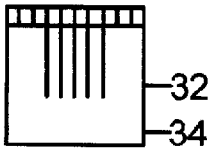
Figure 45A:
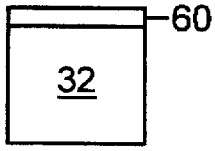
FIGS. 45A-45D are FIGS. 44A-44D showing attachment means joining together the upper portions of a rectangular-shaped outer panel having a reinforced header and a rectangular-shaped inner panel having no reinforced header, and, attachment means joining together the top edge of the inner panel to proximate the top edge of the outer panel.
Figure 45B:
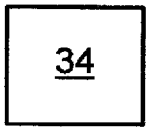
Figure 45C:
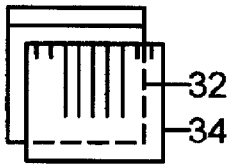
Figure 45D:
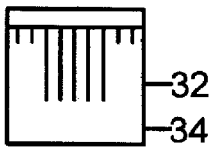
Figure 46A:
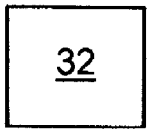
FIGS. 46A-46D are a reverse of FIGS. 45A-45D showing attachment means joining together the upper portions of a rectangular-shaped outer panel having no reinforced header and a rectangular-shaped inner panel having a reinforced header, and, attachment means joining together the top edge of the outer panel to proximate the top edge of the inner panel.
Figure 46B:
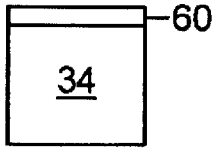
Figure 46C:
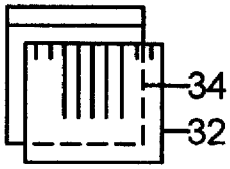
Figure 46D:
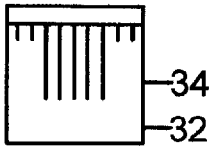
Figure 47A:
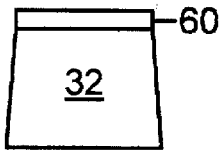
FIGS. 47A-47D are rear views of attachment means joining together the upper portions of a trapezoidal-shaped outer panel and a trapezoidal-shaped inner panel, each panel having a reinforced header.
Figure 47B:
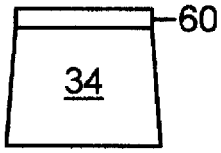
Figure 47C:
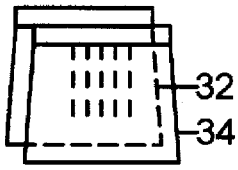
Figure 47D:
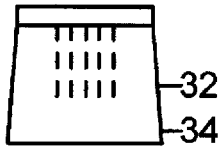
Figure 48A:
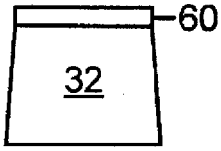
FIGS. 48A-48D are FIGS. 47A-47D showing attachment means joining together either top corners of an outer panel and inner panel.
Figure 48B:
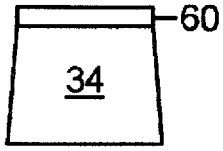
Figure 48C:
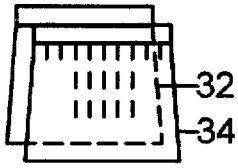
Figure 48D:
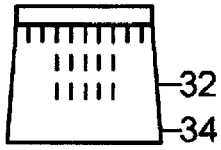
Figures 49A, 49B, 49C, 49D, 50A, 50B, 50C, 50D, 51A, 51B, 51C, 51D, 52A, 52B, 52C, 52D, 52E, 53A, 53B, 53C, 53D, 53E, 54A, 54B, 54C, 54D, 54E:
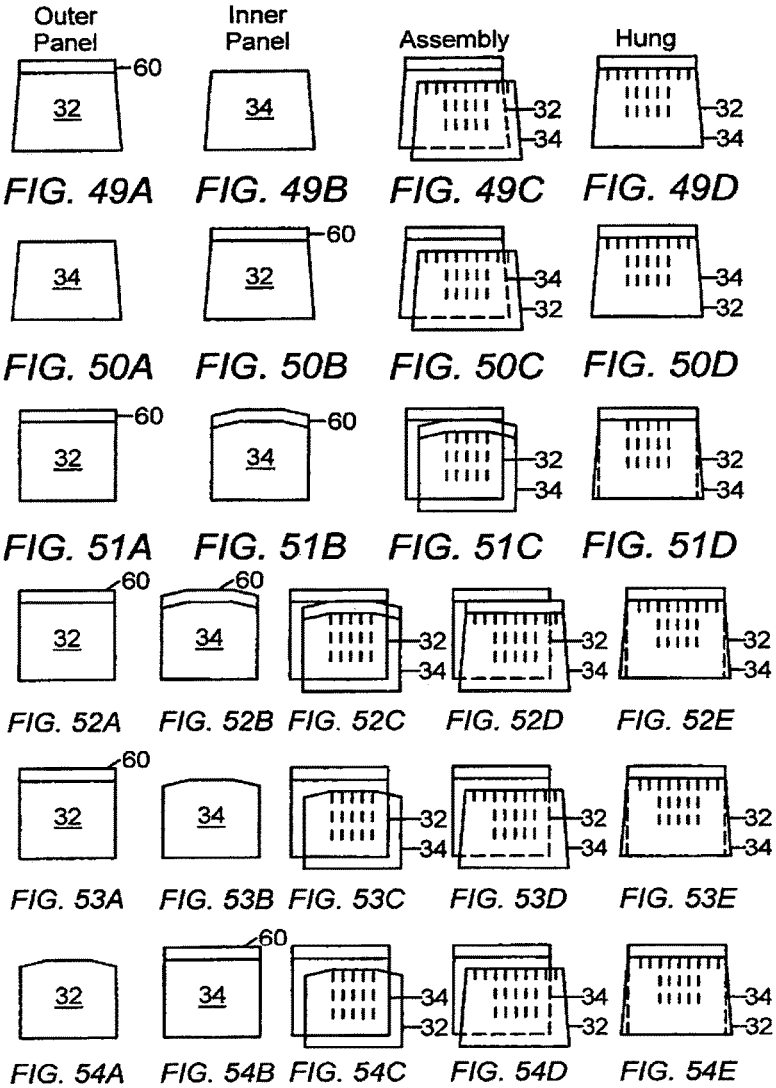
Figures 55A, 55B, 55C, 55D:
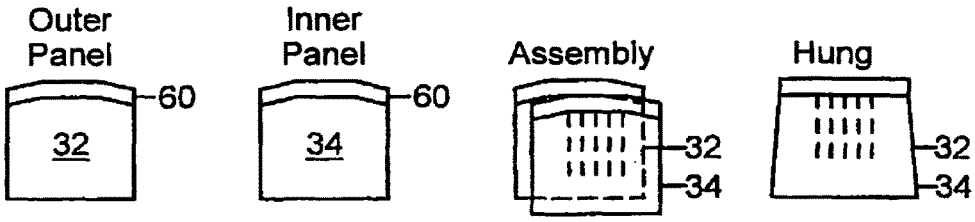
FIGS. 55A-55D are rear views of attachment means joining together the upper portions of a proximate rectangular-shaped outer panel and a proximate rectangular-shaped inner panel, each panel having a reinforced header and a convex angular top edge causing each panel to have flared side edges when the dual panel shower curtain is hung from a shower curtain rod as shown in FIG. 55D.
Figures 56A, 56B, 56C, 56D:
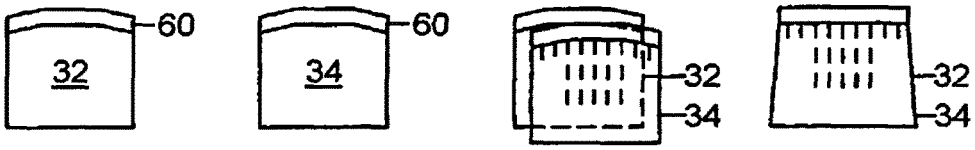
FIGS. 56A-56D are FIGS. 55A-55D showing attachment means joining together either top corners of an outer panel and inner panel, causing the outer panel and the inner panel to have flared side edges when the dual panel shower curtain is hung from a shower curtain rod as shown in FIG. 56D.
Figures 57A, 57B, 57C, 57D:
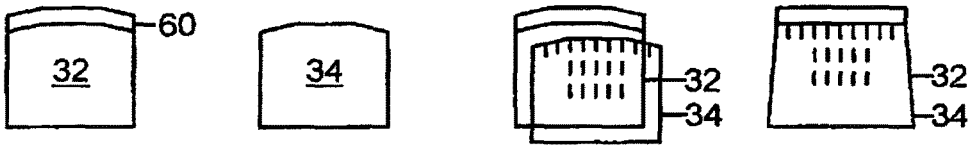
FIGS. 57A-57D are FIGS. 56A-56D showing attachment means joining together the upper portions of a proximate rectangular-shaped outer panel having a reinforced header and a proximate rectangular-shaped inner panel having no reinforced header, and, attachment means joining together the top edge of the inner panel to proximate the top edge of the outer panel, causing the outer panel and the inner panel to have flared side edges when the dual panel shower curtain is hung from a shower curtain rod as shown in FIG. 57D.
Figures 58A, 58B, 58C, 58D:
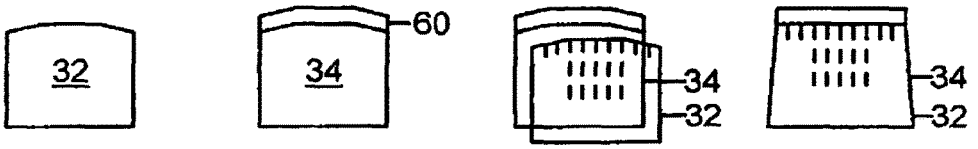
FIGS. 58A-58D are a reverse of FIGS. 57A-57D showing attachment means joining together the upper portions of a proximate rectangular-shaped outer panel having no reinforced header and a proximate rectangular-shaped inner panel having a reinforced header, and, attachment means joining together the top edge of the outer panel to proximate the top edge of the inner panel, causing the outer panel and the inner panel to have flared side edges when the dual panel shower curtain is hung from a shower curtain rod as shown in FIG. 58D.

With reference to FIGS. 33A through 36B, shown therein are spacers 62 in various constructions. In addition to a ring spacer 62 shown in FIG. 18, FIG. 33A shows a front perspective view of a Z-tab spacer 62, FIG. 33B shows a front perspective view of a C-tab spacer 62, FIG. 34A shows a front perspective view of a rectangular tube spacer 62, FIG. 34B shows a front perspective view of a circular tube spacer 62, FIG. 35A shows a front view of a rectangular spacer 62, FIG. 35B shows a front view of a circular spacer 62, FIG. 36A shows a front view of a rectangular bubble spacer 62, and FIG. 36B shows a front view of a circular bubble spacer 62. Spacers 62 may be constructed of conventional shower curtain material, e.g., water impermeable and air impermeable material, such as polyvinyl chloride ("PVC"), ethylene vinyl acetate ("EVA"), polyethylene vinyl acetate ("PEVA"), and so forth, plastic such as mounting strips in FIGS. 20A and 20B, U.S. Pat. No. 6,317,904 (Samelson, Nov. 20, 2001), and so forth.

FIGS. 37A through 40D show various constructions of a dual panel shower curtain 30, e.g., positions of attachment means 52 joining together the upper portions 72 of a rectangular-shaped outer panel 32 and a rectangular-shaped inner panel 34.

With reference to FIGS. 37A through 37D shown therein are attachment means 52, e.g., heat welds 54, joining together the upper portions 72 of an outer panel 32 comprising a reinforced header 60 having apertures 48 (not shown) or grommets and an inner panel 34 comprising a reinforced header 60 having apertures 48 (not shown) or grommets.

FIGS. 38A through 38D are similar to FIGS. 37A through 37D showing additional attachment means 52, e.g., heat welds 54, joining together proximate top corners of the outer panel 32 and the inner panel 34.

FIGS. 39A through 39D are similar to FIGS. 38A through 38D showing attachment means 54, e.g., heat welds 54, joining together the upper portions 72 of the outer panel 32 and the inner panel 34 and joining together the top edge 38 of the inner panel 34 to proximate the top edge 36 of the outer panel 32. The inner panel 34 has no reinforced header 60 nor apertures 48 or grommets.

FIGS. 40A through 40D are the reverse of FIGS. 39A through 39D showing attachment means 54, e.g., heat welds 54, joining together the upper portions 72 of the outer panel 32 and the inner panel 34 and joining together the top edge 36 of the outer panel 32 to proximate the top edge 38 of the inner panel 34. The outer panel 32 has no reinforced header 60 nor apertures 48 or grommets.

FIGS. 41A through 46D are similar to FIGS. 37A through 40D showing elongated attachment means 52, e.g., heat welds 54, joining together the upper portions 72 of a rectangular-shaped outer panel 32 and a rectangular-shaped inner panel 34.

FIGS. 47A through 50D are similar to FIGS. 37A through 40D showing attachment means 52, e.g., heat welds 54, joining together the upper portions 72 of a trapezoidal-shaped outer panel 32 and a trapezoidal-shaped inner panel 34. The trapezoidal-shaped outer panel 32 allows the side edges 40 of the outer panel 32 to overlap the end walls 16, 18 of the bathtub shower enclosure 10 keeping drafts outside of the bathtub shower enclosure 10. The trapezoidal-shaped inner panel 34 allows the side edges 42 of the inner panel 34 to overlap, lay flat, and seal against the end walls 16, 18 of the bathtub shower enclosure 10 and the inside of the bathtub 12 keeping shower splash inside of the bathtub shower enclosure 10.

FIGS. 51A through 54E are similar to FIGS. 47A through 50D showing attachment means 52, e.g., heat welds 54, joining together the upper portions 72 of a rectangular-shaped or proximate rectangular-shaped outer panel 32 and a rectangular-shaped or proximate rectangular-shaped inner panel 34. The proximate rectangular-shaped outer panel 32 or proximate rectangular-shaped inner panel 34 comprise convex top edges 36, 38 having a horizontal top middle edge 64, 66 and either downward-sloping top corner edges 68, 70. When a dual panel shower curtain 30 is hung from a shower curtain rod 26 via shower curtain rings 28, the downward sloping top corner edges 68 of the outer panel 32 are elevated to a horizontal position that creates flared side edges 40 of the outer panel 32 to overlap the end walls 16, 18 of the bathtub shower enclosure 10 keeping drafts outside of the bathtub shower enclosure 10. Similarly, the downward-sloping top corner edges 70 of the inner panel 34 are elevated to a horizontal position that creates flared side edges 42 of the inner panel 34 to overlap, lay flat, and seal against the end walls 16, 18 of the bathtub shower enclosure 10 and the inside of the bathtub 12 keeping shower splash inside of the bathtub shower enclosure 10.

FIGS. 55A through 58D are similar to FIGS. 51A through 54D showing attachment means 52, e.g., heat welds 54, joining together the upper portions 72 of a proximate rectangular-shaped outer panel 32 and a proximate rectangular-shaped inner panel 34. The proximate rectangular-shaped outer panel 32 and proximate rectangular-shaped inner panel 34 comprise convex top edges 36, 38 having a horizontal top middle edge 64, 66 and either downward-sloping corner edges 68, 70. When a dual panel shower curtain 30 is hung from a shower curtain rod 26 via shower curtain rings 28, the downward sloping top corner edges 68 of the outer panel 32 are elevated to a horizontal position that creates flared side edges 40 of the outer panel 32 to overlap the end walls 16, 18 of the bathtub shower enclosure 10 keeping drafts outside of the bathtub shower enclosure 10. Similarly, the downward-sloping top corner edges 70 of the inner panel 34 are elevated to a horizontal position that creates flared side edges 42 of the inner panel 34 to overlap, lay flat, and seal against the end walls 16, 18 of the bathtub shower enclosure 10 and the inside of the bathtub 12 keeping shower splash inside of the bathtub shower enclosure 10.

Figures 59A, 59B, 59C, 59D, 59E:
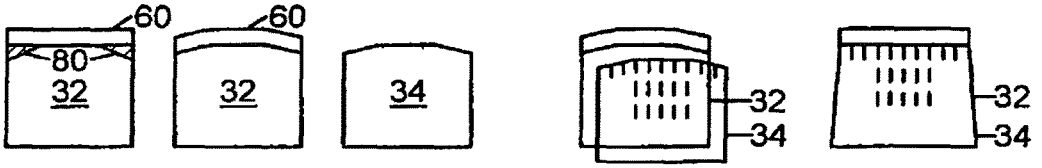
FIGS. 59A-59D are FIGS. 57A-57D showing attachment means joining together the upper portions of a rectangular-shaped outer panel having a reinforced header, transformed into a proximate rectangular-shaped outer panel as shown in FIGS. 59A and 59B, and a proximate rectangular-shaped inner panel having no reinforced header, each panel having a convex angular top edge causing each panel to have flared side edges when the dual panel shower curtain is hung from a shower curtain rod as shown in FIG. 59E.
Figures 60A, 60B, 60C, 60D:
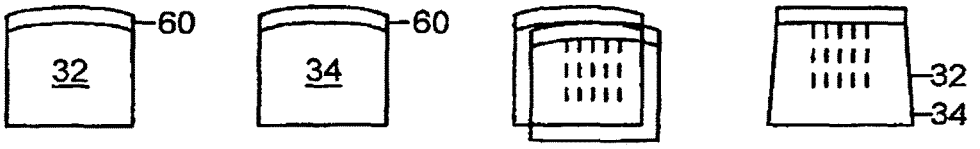
FIGS. 60A-60D are FIGS. 55A-55D showing attachment means joining together the upper portions of a proximate rectangular-shaped outer panel and a proximate rectangular-shaped inner panel, each panel having convex curvature top edges compared to convex angular top edges shown in FIGS. 55A through 55D.
Figure 61A:
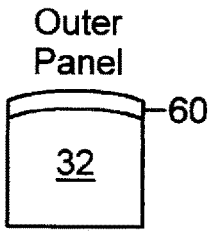
FIGS. 61A-61D are FIGS. 60A-60D showing attachment means joining together either top corners of an outer panel and inner panel.
Figure 61B:
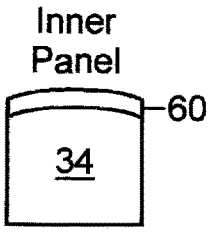
Figure 61C:
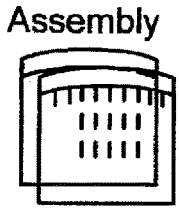
Figure 61D:
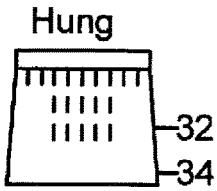
Figure 62A:
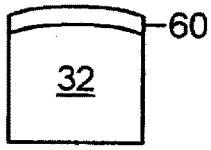
FIGS. 62A-62D are FIGS. 61A-61D showing attachment means joining together the upper portions of a proximate rectangular-shaped outer panel having a reinforced header and a proximate rectangular-shaped inner panel having no reinforced header, and, attachment means joining together the top edge of the inner panel to proximate the top edge of the outer panel, causing the outer panel and the inner panel to have flared side edges when the dual panel shower curtain is hung from a shower curtain rod as shown in FIG. 62D.
Figure 62B:
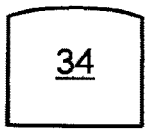
Figure 62C:
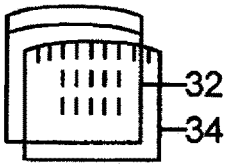
Figure 62D:
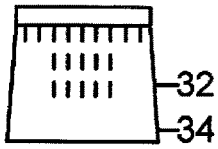
Figure 63A:
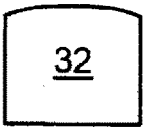
FIGS. 63A-63D are a reverse of FIGS. 62A-62D showing attachment means joining together the upper portions of a proximate rectangular-shaped outer panel having no reinforced header and a proximate rectangular-shaped inner panel having a reinforced header, and, attachment means joining together the top edge of the outer panel to proximate the top edge of the inner panel, causing the outer panel and the inner panel to have flared side edges when the dual panel shower curtain is hung from a shower curtain rod as shown in FIG. 63D.
Figure 63B:
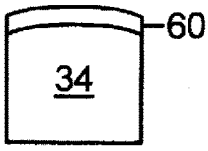
Figure 63C:
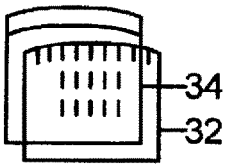
Figure 63D:
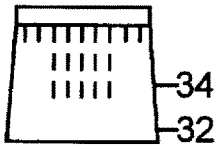
Figure 64A:
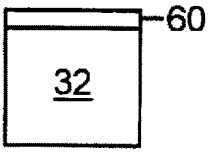
FIGS. 64A-64D are rear views of attachment means joining together the upper portions of a rectangular-shaped outer panel and a corrugated rectangular-shaped inner panel, each panel having a reinforced header.
Figure 64B:
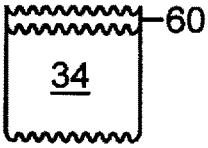
Figure 64C:
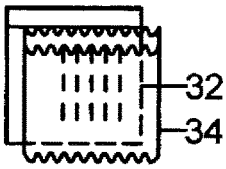
Figure 64D:
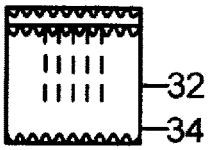
Figure 65A:
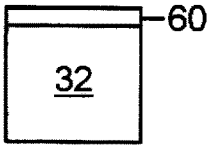
FIGS. 65A-65D are FIGS. 64A-64D showing attachment means joining together either top corners of an outer panel and inner panel.
Figure 65B:
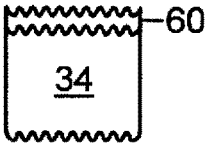
Figure 65C:
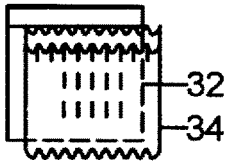
Figure 65D:
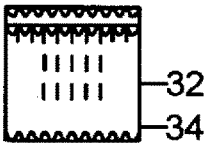
Figure 66A:
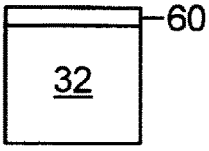
FIGS. 66A-66D are FIGS. 65A-65D showing attachment means joining together the upper portions of a rectangular-shaped outer panel having a reinforced header and a corrugated rectangular-shaped inner panel having no reinforced header, and, attachment means joining together the top edge of the inner panel to proximate the top edge of the outer panel.
Figure 66B:
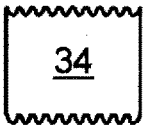
Figure 66C:
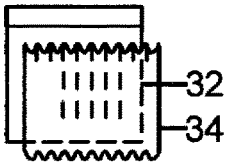
Figure 66D:
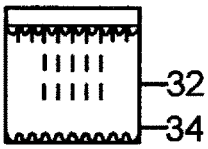
Figures 67A, 67B, 67C, 67D:
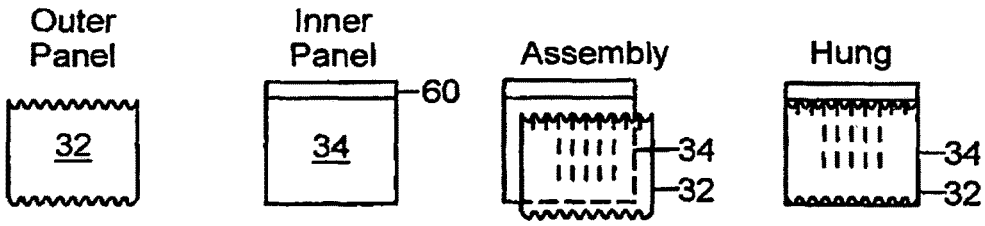
FIGS. 67A-67D are a reverse of FIGS. 66A-66D showing attachment means joining together the upper portions of a corrugated rectangular-shaped outer panel having no reinforced header and a rectangular-shaped inner panel having a reinforced header, and, attachment means joining together the top edge of the outer panel to proximate the top edge of the inner panel.
Figures 68A, 68B, 68C, 68D:
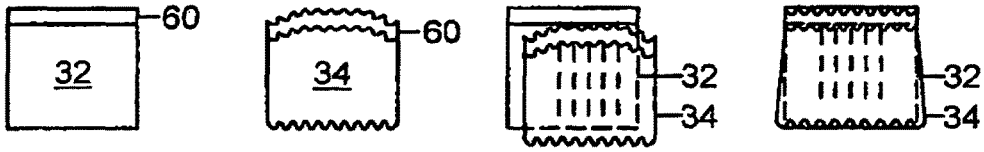
FIGS. 68A-68D are rear views of attachment means joining together the upper portions of a rectangular-shaped outer panel and a corrugated proximate rectangular-shaped inner panel having a convex angular top edge, each panel having a reinforced header, and the convex top edge of the inner panel causing the inner panel to have flared side edges when the dual panel shower curtain is hung from a shower curtain rod as shown in FIG. 68D.
Figures 69A, 69B, 69C, 69D, 69E:
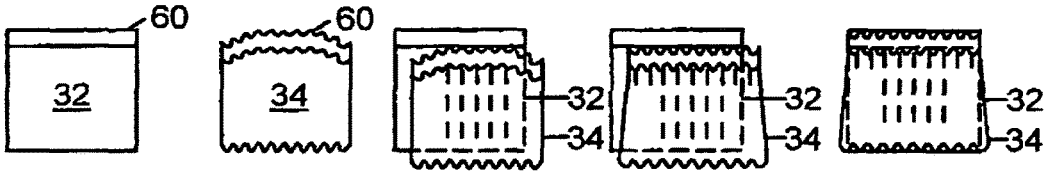
FIGS. 69A-69E are FIGS. 68A-68D showing attachment means joining together either top corners of an outer panel and inner panel.
Figures 70A, 70B, 70C, 70D, 70E:
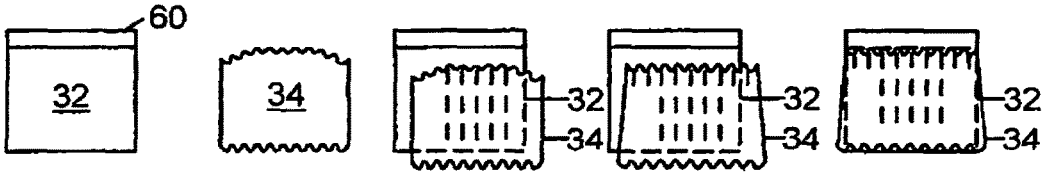
FIGS. 70A-70E are FIGS. 69A-69E showing attachment means joining together the upper portions of a rectangular-shaped outer panel having a reinforced header and a corrugated proximate rectangular-shaped inner panel having no reinforced header and having a convex angular top edge, and, attachment means joining together the top edge of the inner panel to proximate the top edge of the outer panel and the convex top edge of the inner panel causing the inner panel to have flared side edges as shown in FIG. 70E.
Figures 71A, 71B, 71C, 71D, 71E:
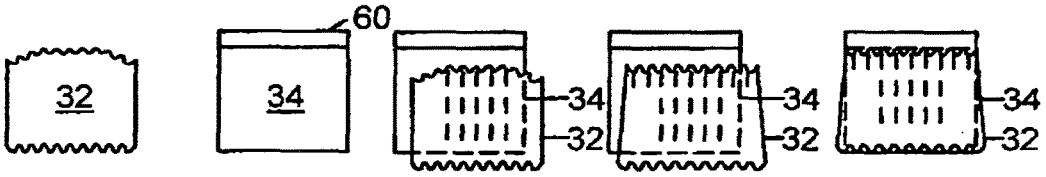
FIGS. 71A-71E are a reverse of FIGS. 70A-70E showing attachment means joining together the upper portions of a corrugated proximate rectangular-shaped outer panel having no reinforced header having a convex angular top edge and a rectangular-shaped inner panel having a reinforced header, and, attachment means joining together the top edge of the outer panel to proximate the top edge of the inner panel and the convex top edge of the outer panel causing the outer panel to have flared side edges as shown in FIG. 71E.
Figures 72A, 72B, 72C, 72D:
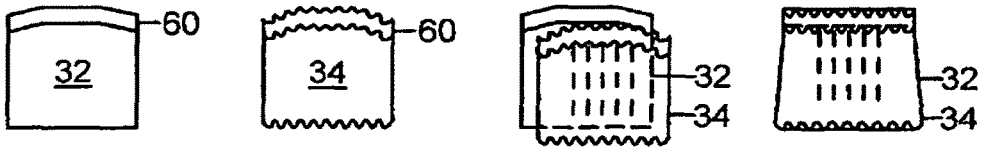
FIGS. 72A-72D are rear views showing attachment means joining together the upper portions of a proximate rectangular-shaped outer panel and a corrugated proximate rectangular-shaped inner panel, each panel having a reinforced header and convex angular top edge, and, the convex angular top edge of the outer panel and the inner panel causing the outer panel and the inner panel to have flared side edges when the dual panel shower curtain is hung from a shower curtain rod as shown in FIG. 72D.
Figure 73A:
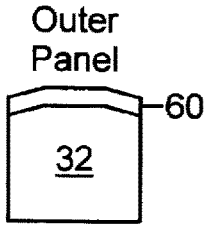
FIGS. 73A-73D are FIGS. 72A-72D showing additional attachment means joining together either upper corners of an outer panel and inner panel.
Figure 73B:
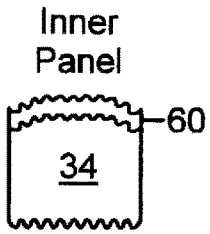
Figure 73C:
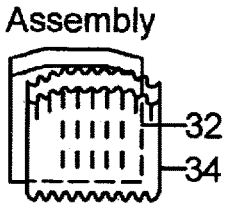
Figure 73D:
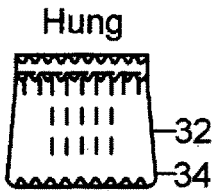
Figure 74A:
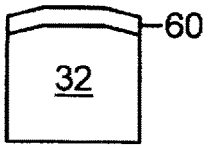
FIGS. 74A-74D are FIGS. 73A-73D showing attachment means joining together the upper portions of a proximate rectangular-shaped outer panel having a reinforced header and a corrugated proximate rectangular-shaped inner panel having no reinforced header, each panel having a convex angular top edge, and, attachment means joining together the top edge of the inner panel to proximate the top edge of the outer panel and the convex top edge of the outer panel causing the outer panel and the inner panel to have flared side edges when the dual panel shower curtain is hung from a shower curtain rod as shown in FIG. 74D.
Figure 74B:
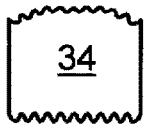
Figure 74C:
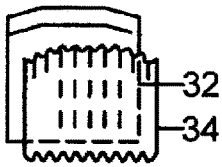
Figure 74D:
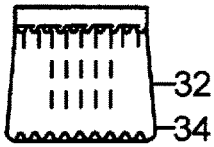
Figure 75A:
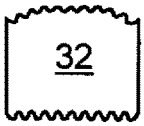
FIGS. 75A-75D are a reverse of FIGS. 74A-74D showing attachment means joining together the upper portions of a corrugated proximate rectangular-shaped outer panel having no reinforced header and a proximate rectangular-shaped inner panel having a reinforced header, each panel having a convex angular top edge, and, attachment means joining together the top edge of the outer panel to proximate the top edge of the inner panel and the convex top edge of the inner panel causing the outer panel and the inner panel to have flared side edges when the dual panel shower curtain is hung from a shower curtain rod as shown in FIG. 75D.
Figure 75B:
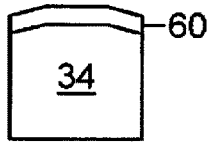
Figure 75C:
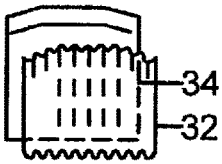
Figure 75D:
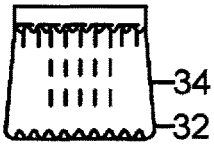
Figure 76A:
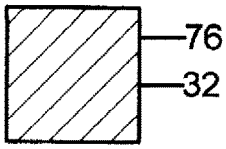
FIGS. 76A-76D are front views of an opaque outer panel and a transparent or translucent inner panel.
Figure 76B:
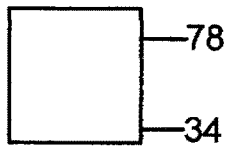
Figure 76C:
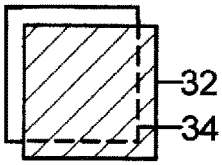
Figure 76D:
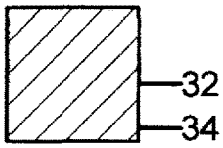
Figure 77A:
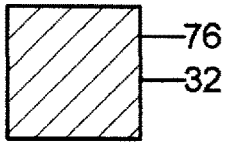
FIGS. 77A-77D are front views of an opaque outer panel and an opaque inner panel.
Figure 77B:
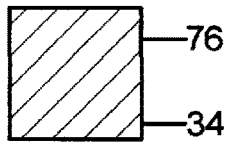
Figure 77C:
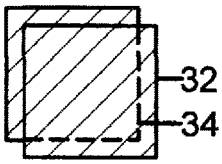
Figure 77D:
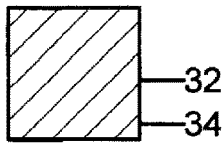
Figure 78A:
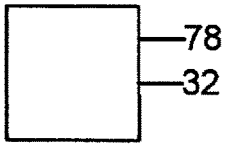
FIGS. 78A-78D are front views of a transparent or translucent outer panel and transparent or translucent inner panel.
Figure 78B:
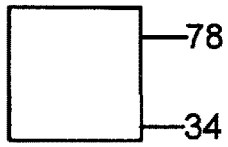
Figure 78C:
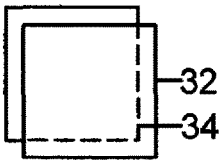
Figure 78D:
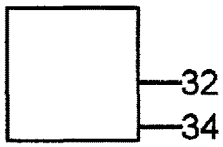
Figures 79A, 79B, 79C, 79D:
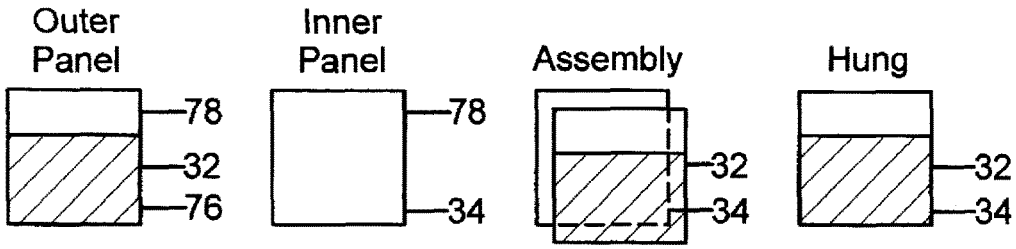
FIGS. 79A-79D are front views of an opaque outer panel having a transparent or translucent upper portion and a transparent or translucent inner panel.
Figures 80A, 80B, 80C, 80D:
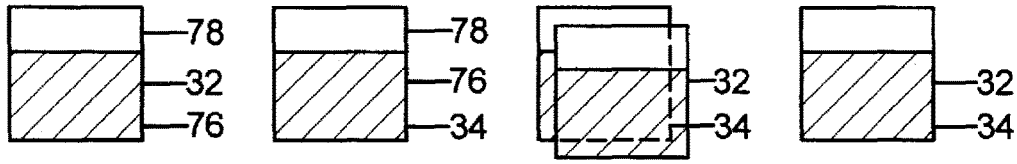
FIGS. 80A-80D are front views of an opaque outer panel and an opaque inner panel, each panel having a transparent or translucent upper portion.
Figures 81A, 81B, 81C, 81D:
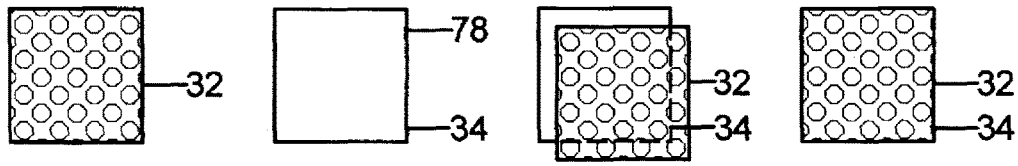
FIGS. 81A-81D are front views of a decorative outer panel and a transparent or translucent inner panel.
Figures 82A, 82B, 82C, 82D:
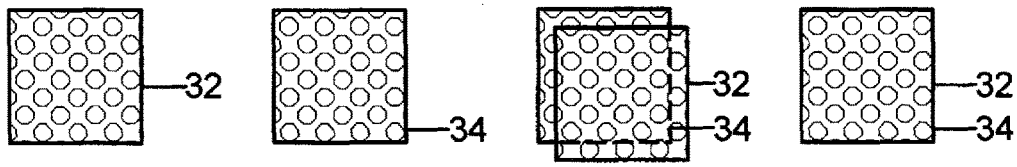
FIGS. 82A-82D are front views of a decorative outer panel and a decorative inner panel.
Figures 83A, 83B, 83C, 83D:
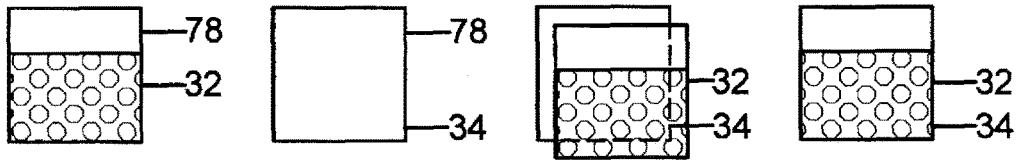
FIGS. 83A-83D are front views of a decorative outer panel having a transparent or translucent upper portion and a transparent or translucent inner panel.
Figures 84A, 84B, 84C, 84D:
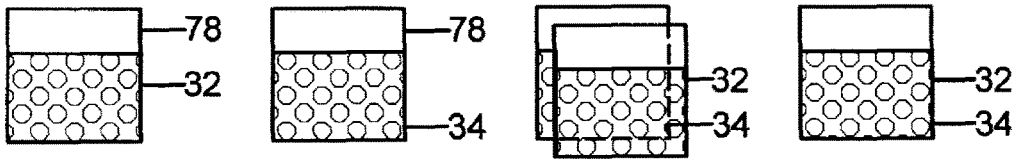
FIGS. 84A-84D are front views of a decorative outer panel and a decorative inner panel, each panel having a transparent or translucent upper portion.
Figures 85A, 85B, 85C, 85D, 86A, 86B, 86C, 86D, 87A, 87B, 87C, 87D, 88A, 88B, 88C, 88D, 89A, 89B, 89C, 89D, 90A, 90B, 90C, 90D:
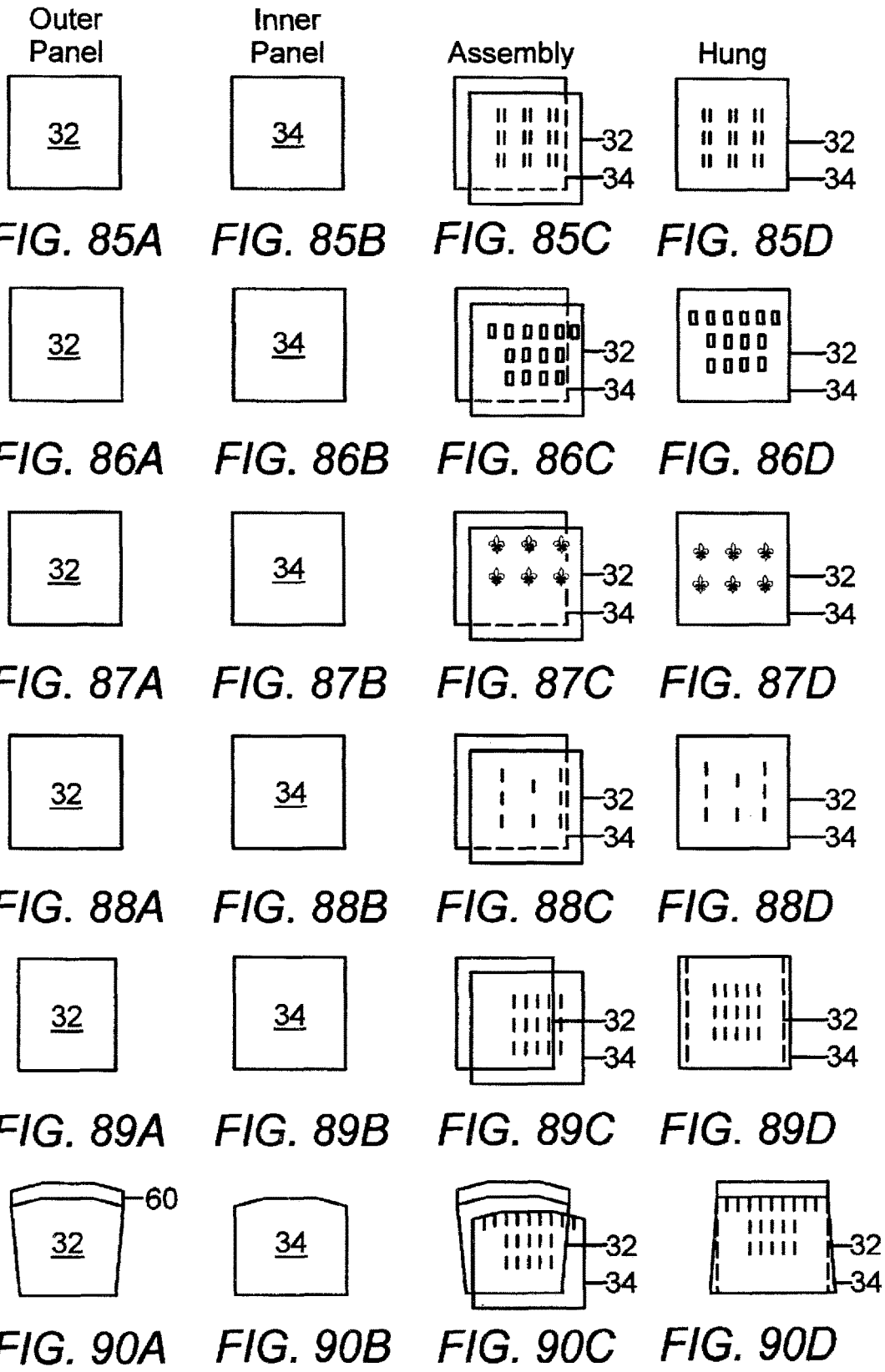
FIGS. 85A-85D are rear views of reinforced attachment means joining together the upper portion of an outer panel and an inner panel joined.
FIGS. 86A-86D are rear views of reinforced rectangular-shaped attachment means joining together the upper portion of an outer panel and an inner panel.
FIGS. 87A-87D are rear views of reinforced decorative attachment means joining together an outer panel and an inner panel.
FIGS. 88A-88D are rear views of asymmetrically positioned attachment means joining together the upper portions of an outer panel and an inner panel.
FIGS. 89A-89D are rear views of attachment means joining together a narrow rectangular-shaped outer panel and a rectangular-shaped inner panel.
FIGS. 90A-90D are rear views of attachment means joining together a proximate rectangular-shaped outer panel having a reinforced header and a proximate rectangular-shaped inner panel having no reinforced header, both panels having an angular convex top edge and attachment joining the top edge of the inner panel to proximate the top edge of the outer panel and the convex top edge of the outer panel causes the outer panel to have vertical side edges and the inner panel to have flared side edges when the dual panel shower curtain is hung from a shower curtain rod in FIG. 90D.

FIGS. 59A through 59E are similar to FIGS. 57A through 57D showing the removal or folding of conventional shower curtain material proximate to the top corners 80 of the outer panel 32 to construct an outer panel having a convex top edge 36 comprising a horizontal top middle edge 64 and either downward-sloping top corner edges 68. Construction of an outer panel 32 or an inner panel 34 comprising a convex top edge 36, 38, particularly a convex reinforced header 60, may be more costly to manufacture than a conventional horizontal top edge 36, 38. FIGS. 59A and 59B show an alternative method of manufacturing a convex top edge 36, 38 or a reinforced convex header 60 by modifying an outer panel 32 or an inner panel 34 or both panels having a horizontal top edge 36, 38.

FIGS. 60A through 63D are similar to FIGS. 55A through 58D showing attachment means 52 joining together the upper portions 72 of a proximate rectangular-shaped outer panel 32 and a proximate rectangular-shaped inner panel 34. The outer panel 32 and the inner panel 34 comprise curved convex top edges 36, 38. Construction of an outer panel 32 or an inner panel 34 or both panels comprising a curved convex top edge 36, 38 may be less costly to manufacture than a convex top edge 36, 38 comprising a horizontal top middle edge 64, 66 and downward-sloping top corner edges 68, 70 having angular downward-sloping top corner edges 68, 70 shown in, for example, FIGS. 55A and 55B.

FIGS. 64A through 66D are similar to FIGS. 37A through 39D showing attachment means 54 joining together the upper portions 72 of a rectangular-shaped outer panel 32 and a corrugated rectangular-shaped inner panel 34. The corrugated rectangular-shaped inner panel 34 creates vertical channels 56 between the upper portions 72 of the outer panel 32 and the inner panel 34 minimizing the effects of air pressure against and in between the outer panel 32 and the inner panel 34 and increasing the drying rate and minimizing the occurrence of mold and/or mildew in between the outer panel 32 and the inner panel 34.

FIGS. 67A through 67D are the reverse of FIGS. 66A through 66D showing attachment means 54 joining together the upper portions 72 of a corrugated rectangular-shaped outer panel 32 and a rectangular-shaped inner panel 34.

FIGS. 68A through 70E are similar to FIGS. 51A through 53E and FIGS. 64A through 66D showing attachment means 54 joining together the upper portions 72 of a proximate rectangular-shaped outer panel 32 and a corrugated proximate rectangular-shaped inner panel 34 having a convex top edge 38. When a dual panel shower curtain 30 is hung from a shower curtain rode 26 via shower curtain rings 28, the downward sloping top corner edges 70 of the inner panel 34 are elevated to a horizontal position that creates flared side edges 42 of the inner panel 34 to overlap, lay flat, and seal against the end walls 16, 18 of the bathtub shower enclosure 10 and the inside of the bathtub 12 keeping shower splash inside of the bathtub shower enclosure 10.

FIGS. 71A through 71E are the reverse of FIGS. 70A through 70E showing attachment means 54 joining together the upper portions 72 of a corrugated wide proximate rectangular-shaped outer panel 32 and a rectangular-shaped inner panel 34.

FIGS. 72A through 74D are similar to FIGS. 55A through 57D and FIGS. 68A through 70E showing attachment means 54 joining together the upper portions 72 of a proximate rectangular-shaped outer panel 32 and a corrugated proximate rectangular-shaped inner panel 34, each panel having a convex top edge 36, 38. When a dual panel shower curtain 30 is hung from a shower curtain rod 26 via shower curtain rings 28 or hooks, the downward-sloping top corner edges 68 are elevated to a horizontal position that creates flared side edges 40 of the outer panel 32 to overlap the end walls 16, 18 of the bathtub shower enclosure 10 keeping drafts outside of the bathtub shower enclosure 10. Similarly, the downward-sloping top corner edges 70 are elevated to a horizontal position that creates flared side edges 42 of the inner panel 34 to overlap, lay flat, and seal against the end walls 16, 18 of the bathtub shower enclosure 10 and the inside of the bathtub 12 keeping shower splash inside of the bathtub shower enclosure 10.

FIGS. 75A through 75D are the reverse of FIGS. 74A through 74D showing attachment means 54 joining together the upper portions 72 of a corrugated proximate rectangular-shaped outer panel 32 and a proximate rectangular-shaped inner panel 34, each panel having a convex top edge 36, 38.

With reference to FIGS. 76A through 84D shown therein are various constructions of an outer panel 32 and an inner panel 34 comprising opaque 76, transparent 78 or translucent, or decorative conventional shower curtain material or a combination of these materials. An outer panel 32 comprising part opaque 76 or part decorative conventional shower curtain material and part transparent 78 or translucent material allows an individual to view from inside of a bathtub shower enclosure 10 to outside of the bathtub shower enclosure 10. Further, the transparent 78 or translucent conventional shower curtain material allows light to stream into the bathtub shower enclosure 10. An inner panel 34 comprising transparent 78 or translucent conventional shower curtain material allows an individual to view the form of the bathtub shower enclosure 10 making the bathtub shower enclosure 10 appear wider and allows an individual to view the form of the bathtub shower enclosure 10 for safely entering or exiting the bathtub shower enclosure 10.

With reference to FIGS. 85A through 87D shown therein are various constructions of reinforced attachment means 52 joining together the upper portions 72 of an outer panel 32 and an inner panel 34. The reinforced attachment means 52 may be in the form of additional attachment means 52, e.g., heat welds 54. Further, reinforced attachment means 52 may be in the form of reinforcement strips of conventional shower curtain material, plastic mounting strips in FIGS. 20A and 20B, reinforced shapes or designs, e.g., a reinforced rectangle, a reinforced circle, a reinforced fleur de lis design, and so forth. And further, reinforced attachment means 52 may be positioned on the circumference of the main body of the vertical grid pattern of attachment means 52 whereas unreinforced attachment means 52 may be positioned inside of the circumference of the vertical grid pattern of attachment means 54.

With reference to FIGS. 88A through 88D shown therein are attachment means 52 joining together in a vertical grid pattern the upper portions 72 of the outer panel 32 and the inner panel 34 wherein the attachment means 52 may be asymmetrically positioned within the vertical grid pattern.

With reference to FIGS. 89A through 89D shown therein is a narrow rectangular-shaped outer panel 32 and a rectangular-shaped inner panel 34. An individual may hang a decorative shower curtain from a shower curtain bar 26 via shower curtain rings 28 or hooks wherein the decorative shower curtain hides the narrow rectangular-shaped outer panel 32 from view for an aesthetic appearance.

With reference to FIGS. 90A through 90D shown therein is a proximate trapezoidal-shaped outer panel 32 and a proximate rectangular-shaped inner panel 34 wherein each panel 32, 34 having a convex top edge 36, 38 comprising a horizontal top middle edge 64, 66 and downward-sloping top corner edges 68, 70. An individual may hang a decorative shower curtain from a shower curtain rod 26 via shower curtain rings 28 or hooks such that the decorative shower curtain hides the outer panel 32 and the inner panel 34 from view for an aesthetic appearance. The outer panel 32 and the inner panel 34 may comprise other combinations, e.g., either or both the outer panel 32 and the inner panel 34 having a reinforced header 60, and so forth.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A dual panel shower curtain comprising:
   an inner panel having a top edge, a bottom edge and side edges;
   an outer panel having a top edge, a bottom edge and side edges;
   at least one attachment means joining together an upper portion of the inner panel and an upper portion of the outer panel; and
   a plurality of apertures positioned transversely across a top edge of at least one panel for attaching the dual panel shower curtain directly to a shower curtain rod via shower curtain rings;
   said at least one attachment means is a plurality of heat welds forming an array defined by a vertical grid pattern positioned transversely across between the upper portions of the inner panel and the outer panel creating vertical folds of shower curtain material in the inner panel and in the outer panel.

2. The dual panel shower curtain of claim 1 in wherein:
   the inner panel and the outer panel comprise heavyweight air impermeable and water impermeable polyvinyl chloride, polyethylene vinyl acetate, or ethylene vinyl acetate flexible plastic sheet material having a thickness from about 7-gauge or 0.07 mil to about 15-gauge or 0.15 mil.

3. The dual panel shower curtain of claim 1 further comprising:
   at least one magnet or weight positioned transversely across proximate the bottom edge of the inner panel and the outer panel.

4. The dual panel shower curtain of claim 1 further comprising:
   a reinforced header positioned transversely across a top edge of at least one panel of the dual panel shower curtain.

5. The dual panel shower curtain of claim 1 wherein:
   said at least one attachment means and/or aperture joins together the upper portions of the inner panel and the outer panel and is a range from about 10 cm to about 20 cm of another attachment means and/or aperture.

6. The dual panel shower curtain of claim 1 wherein:
   said plurality of apertures is a split-ring design for attaching the dual panel shower curtain directly to a shower curtain rod.

7. The dual panel shower curtain of claim 1 wherein:
   at least one panel comprises pleated side edges such that the side edges of the inner panel overlap, lay flat and seal against end walls of a bathtub shower enclosure.

8. The dual panel shower curtain of claim 1 wherein:
at least one panel comprises a bottom edge that is wider than the top edge such that side edges of the inner panel overlap, lay flat and seal against end walls of a bathtub shower enclosure.

9. The dual panel shower curtain of claim 1 wherein:
at least one panel comprises a convex top edge to affect flared side edges such the side edges of the inner panel overlap, lay flat and seal against end walls of a bathtub shower enclosure.

10. The dual panel shower curtain of claim 1 wherein:
at least one panel comprises a corrugated panel to create vertical channels between the inner panel and the outer panel.

11. The dual panel shower curtain of claim 1 further comprising:
at least one spacer positioned between or proximate to corresponding attachment means and/or apertures of the inner panel and the outer panel to create vertical channels between the inner panel and the outer panel.

12. The dual panel shower curtain of claim 1 further comprising:
at least one panel is a corrugated panel and at least one spacer is positioned between or proximate to corresponding attachment means and/or apertures of the inner panel and the outer panel to create vertical channels between the inner panel and the outer panel.

13. The dual panel shower curtain of claim 1 wherein:
at least one comprises a panel measuring from about one-eighth inch to about one-and-one-half inches shorter in width on either side than a second panel whereby an individual may hang a decorative shower curtain in front of a dual panel shower curtain and thus hide the dual panel shower curtain from view for an aesthetically pleasing appearance.

14. The dual panel shower curtain of claim 1 wherein:
at least one suction cup mounting strip is attached along the side edges of an inner panel.

15. A dual panel shower curtain comprising:
an inner panel having a top edge, a bottom edge and side edges;
an outer panel having a top edge, a bottom edge and side edges;
at least one attachment means joining together an upper portion of the inner panel and an upper portion of the outer panel; and
a plurality of apertures positioned transversely across a top edge of at least one panel for attaching the dual panel shower curtain directly to a shower curtain rod via shower curtain rings;
the inner panel and the outer panel comprise heavyweight air impermeable and water impermeable polyvinyl chloride, polyethylene vinyl acetate, or ethylene vinyl acetate flexible plastic sheet material having a thickness from about 7-gauge or 0.07 mil to about 15-gauge or 0.15 mil;
said at least one attachment means is a plurality of heat welds forming an array defined by a vertical grid pattern positioned transversely across between the upper portions of the inner panel and the outer panel creating vertical folds of shower curtain material in the inner panel and in the outer panel;
a reinforced header positioned transversely across a top edge of at least one panel of the dual panel shower curtain.

16. The dual panel shower curtain of claim 15 further comprising:
at least one magnet or weight positioned transversely across proximate the bottom edge of the inner panel and the outer panel.

17. The dual panel shower curtain of claim 15 wherein:
said at least one attachment means and/or aperture joins together the upper portions of the inner panel and the outer panel and is positioned within a range from about 10 cm to about 20 cm of another attachment means and/or aperture.

18. The dual panel shower curtain of claim 15 wherein:
said plurality of apertures is a split-ring design for attaching the dual panel shower curtain directly to a shower curtain rod.

19. The dual panel shower curtain of claim 15 wherein:
at least one panel comprises side edges comprising extra shower curtain material whereby the side edges of the inner panel overlap, lay flat and seal against end walls of a bathtub shower enclosure, selected from the group consisting of at least one panel having pleated side edges, at least one panel having a bottom edge that is wider than the top edge and at least one panel having a convex top edge to affect flared side edges.

20. The dual panel shower curtain of claim 15 wherein:
at least one panel comprises vertical channels between the inner panel and the outer panel selected from the group consisting of at least one panel having attachment means arranged in a vertical grid pattern spaced across between the upper portions of an inner panel and an outer panel, at least one panel having offset attachment means and/or offset apertures joining together the upper portions of an inner panel and an outer panel, at least one panel being a corrugated panel, at least one panel having at least one spacer positioned between or proximate to corresponding attachment means and/or apertures of the inner panel and the outer panel, and at least one panel being a corrugated panel and at least one spacer is positioned between or proximate to corresponding attachment means and/or apertures of the inner panel and the outer panel.

21. The dual panel shower curtain of claim 15 wherein:
at least one panel comprises a panel measuring from about one-eighth inch to about one-and-one-half inches shorter in width on either side than a second panel whereby an individual may hang a decorative shower curtain in front of a dual panel shower curtain and thus hide the dual panel shower curtain from view for an aesthetically pleasing appearance.

22. A dual panel shower curtain comprising:
an inner panel having a top edge, a bottom edge and side edges;
an outer panel having a top edge, a bottom edge and side edges;
at least one attachment means joining together an upper portion of the inner panel and an upper portion of the outer panel; and
a plurality of apertures positioned transversely across a top edge of at least one panel for attaching the dual panel shower curtain directly to a shower curtain rod via shower curtain rings;
the inner panel and the outer panel comprise heavyweight air impermeable and water impermeable polyvinyl chloride, polyethylene vinyl acetate, or ethylene vinyl acetate flexible plastic sheet material having a thickness from about 7-gauge or 0.07 mil to about 15-gauge or 0.15 mil;
said at least one attachment means is a plurality of heat welds forming an array defined by a vertical grid pattern positioned transversely across between the upper portions of the inner panel and the outer panel creating vertical folds of shower curtain material in the inner panel and in the outer panel;

a reinforced header positioned transversely across a top edge of at least one panel of the dual panel shower curtain;

at least one panel comprises side edges comprising extra shower curtain material whereby the side edges of the inner panel overlap, lay flat and seal against end walls of a bathtub shower enclosure, selected from the group consisting of at least one panel having pleated side edges, at least one panel having a bottom edge that is wider than the top edge and at least one panel having a convex top edge to affect flared side edges;

at least one panel comprises vertical channels between the inner panel and the outer panel selected from the group consisting of at least one panel having attachment means arranged in a vertical grid pattern spaced across between the upper portions of an inner panel and an outer panel, at least one panel having offset attachment means and/or offset apertures joining together the upper portions of an inner panel and an outer panel, at least one panel being a corrugated panel, at least one panel having at least one spacer positioned between or proximate to corresponding attachment means and/or apertures of the inner panel and the outer panel, and at least one panel being a corrugated panel and at least one spacer is positioned between or proximate to corresponding attachment means and/or apertures of the inner panel and the outer panel.

23. The dual panel shower curtain of claim 22 further comprising:

at least one magnet or weight positioned transversely across proximate the bottom edge of the inner panel and the outer panel.

24. The dual panel shower curtain of claim 22 wherein:

said plurality of apertures is a split-ring design for attaching the dual panel shower curtain directly to a shower curtain rod.

25. The dual panel shower curtain of claim 22 wherein:

at least one panel comprises a narrow panel whereby an individual may hang a decorative shower curtain in front of a dual panel shower curtain and thus hide the dual panel shower curtain from view for an aesthetically pleasing appearance.

26. The dual panel shower curtain of claim 22 wherein:

at least one suction cup mounting strip is attached along the side edges of an inner panel.

27. A dual panel shower curtain comprising:

an inner panel having a top edge, a bottom edge and side edges;

an outer panel having a top edge, a bottom edge and side edges;

at least one attachment means joining together an upper portion of the inner panel and an upper portion of the outer panel; and a plurality of apertures positioned transversely across a top edge of at least one panel for attaching the dual panel shower curtain directly to a shower curtain rod via shower curtain rings;

the inner panel and the outer panel comprise heavyweight air impermeable and water impermeable polyvinyl chloride polyethylene vinyl acetate or ethylene vinyl acetate flexible plastic sheet material having a thickness from about 7-gauge or 0.07 mil to about 15-gauge or 0.15 mil;

said at least one attachment means is a plurality of heat welds forming an array defined by a vertical grid pattern positioned transversely across between the upper portions of the inner panel and the outer panel creating vertical folds of shower curtain material in the inner panel and in the outer panel;

a reinforced header positioned transversely across a top edge of at least one panel of the dual panel shower curtain;

at least one panel comprises side edges comprising extra shower curtain material whereby the side edges of the inner panel overlap, lay flat and seal against end walls of a bathtub shower enclosure, selected from the group consisting of at least one panel having pleated side edges, at least one panel having a bottom edge that is wider than the top edge and at least one panel having a convex top edge to affect flared side edges;

at least one panel comprises vertical channels between the inner panel and the outer panel selected from the group consisting of at least one panel having attachment means arranged in a vertical grid pattern spaced across between the upper portions of an inner panel and an outer panel, at least one panel having offset attachment means and/or offset apertures joining together the upper portions of an inner panel and an outer panel, at least one panel being a corrugated panel, at least one panel having at least one spacer positioned between or proximate to corresponding attachment means and/or apertures of the inner panel and the outer panel, and at least one panel being a corrugated panel and at least one spacer is positioned between or proximate to corresponding attachment means and/or apertures of the inner panel and the outer panel;

said at least one attachment means and/or aperture joins together the upper portions of the inner panel and the outer panel and is positioned within a range from about 10 cm to about 20 cm of another attachment means and/or aperture.

28. The dual panel shower curtain of claim 27 further comprising:

at least one magnet or weight positioned transversely across proximate the bottom edge of the inner panel and the outer panel.

29. The dual panel shower curtain of claim 27 wherein:

said plurality of apertures is a split-ring design for attaching the dual panel shower curtain directly to a shower curtain rod.

30. The dual panel shower curtain of claim 27 wherein:

at least one panel comprises a narrow panel whereby an individual may hang a decorative shower curtain in front of a dual panel shower curtain and thus hide the dual panel shower curtain from view for an aesthetically pleasing appearance.

31. The dual panel shower curtain of claim 27 wherein:

at least one suction cup mounting strip is attached along the side edges of an inner panel.

* * * * *